US006651604B2

(12) United States Patent
Ahmadi et al.

(10) Patent No.: US 6,651,604 B2
(45) Date of Patent: Nov. 25, 2003

(54) DELIVERY DEVICE FOR REMOVING INTERIOR ENGINE DEPOSITS IN A RECIPROCATING INTERNAL COMBUSTION ENGINE

(75) Inventors: Majid R. Ahmadi, Pleasant Hill, CA (US); Damon C. Vaudrin, Vacaville, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 10/349,581

(22) Filed: Jan. 22, 2003

(65) Prior Publication Data

US 2003/0158061 A1 Aug. 21, 2003

Related U.S. Application Data

(63) Continuation-in-part of application No. 10/056,123, filed on Jan. 23, 2002, and a continuation-in-part of application No. 10/289,799, filed on Nov. 6, 2002, now Pat. No. 6,616,776.

(51) Int. Cl.[7] ..... F02B 1/14; F02B 3/12

(52) U.S. Cl. ..... 123/184.21; 123/50 R; 123/198 A; 123/184.48

(58) Field of Search ..... 510/185, 186, 510/187, 188; 123/50 R, 198 A, 184.21, 184.48

(56) References Cited

U.S. PATENT DOCUMENTS

| | | | | |
|---|---|---|---|---|
| 4,671,230 | A | | 6/1987 | Turnipseed |
| 4,784,170 | A | | 11/1988 | Romanelli et al. |
| 4,800,848 | A | | 1/1989 | Hubbard |
| 4,807,578 | A | | 2/1989 | Adams et al. |
| 4,881,945 | A | | 11/1989 | Buckley, III |
| 4,989,561 | A | | 2/1991 | Hein et al. |
| 4,992,187 | A | | 2/1991 | Adams et al. |
| 5,097,806 | A | | 3/1992 | Vataru et al. |
| 5,257,604 | A | | 11/1993 | Vataru et al. |
| 5,452,696 | A | | 9/1995 | Flynn |
| 5,503,683 | A | | 4/1996 | Butcher et al. |
| 5,669,939 | A | | 9/1997 | Cherpeck |
| 5,749,929 | A | | 5/1998 | Cherpeck et al. |
| 5,858,942 | A | | 1/1999 | Adams et al. |
| 6,073,638 | A | | 6/2000 | Sasaki et al. |
| 6,192,901 | B1 | | 2/2001 | Rome et al. |
| 6,203,584 | B1 | | 3/2001 | Fuentes-Afflick et al. |
| 6,217,621 | B1 | | 4/2001 | Modebelu et al. |
| 6,279,550 | B1 | * | 8/2001 | Bryant ..... 123/559.1 |
| 6,478,036 | B1 | | 11/2002 | Connors et al. |
| 6,541,435 | B2 | * | 4/2003 | Gatzke ..... 510/185 |
| 2002/0107161 | A1 | | 8/2002 | Gatzke |

FOREIGN PATENT DOCUMENTS

| | | |
|---|---|---|
| EP | 1 122 295 A1 | 8/2001 |
| WO | WO 90/10051 | 9/1990 |
| WO | WO 92/07176 | 4/1992 |
| WO | W0 00/33981 | 6/2000 |

OTHER PUBLICATIONS

S. Matsushita, "Development of Direct Injection S.I. Engine (D–4)", Proceedings of JSAE (Japanese Society of Automotive Engineers), No. 9733440, pp. 33–38, Mar. 1997.

* cited by examiner

*Primary Examiner*—Gregory Delcotto
(74) *Attorney, Agent, or Firm*—Joseph P. Foley; Claude J. Caroli

(57) ABSTRACT

Disclosed is an apparatus and application tool useful for removing engine deposits in a reciprocating internal combustion engine by directing a substantial portion of a cleaning composition to an interior cavity of the engine through an access port wherein the point of delivery is independent of the access port and positionable within the interior of the engine cavity.

20 Claims, 4 Drawing Sheets

DELIVERY DEVICE FOR REMOVING INTERIOR ENGINE DEPOSITS IN A RECIPROCATING INTERNAL COMBUSTION ENGINE

This application is a continuation in part of 10/056,123, filed Jan. 23, 2002 and a continuation in part of 10/289,799, now U.S. Pat. No. 6,616,776, filed Nov. 6, 2002.

BACKGROUND OF THE INVENTION

1. Field of the Invention

This invention relates to a device for delivering a cleaning composition into a desired location within the interior cavity of a reciprocating internal combustion engine. Such a device has at least one orifice located inside the engine cavity and allows for administration of the cleaning composition to a specified interior location, for example, at the point of a problematic deposit; thereby allowing for a fluid delivery point that is independent of the fuel delivery system and without constraints of solely relying upon combustion air (or other external means) as the carrier, to deliver the cleaning composition to a carbonaceous deposit requiring removal. This device is useful for removing engine deposits in a reciprocating internal combustion engine by directing a substantial portion of the cleaning composition at the point of, or in close proximity to, the deposit in the interior of the engine. More particularly, this invention relates to a device and application tool containing the same, which allows for the controlled delivery of a cleaning composition to one or more specified locations within the interior cavity of a reciprocating internal combustion engine having a least one interior surface to be cleaned.

2. Description of the Related Art

It is well known that reciprocating internal combustion engines tend to form carbonaceous deposits on the surface of engine components, such as carburetor ports, throttle bodies, fuel injectors, intake ports and intake valves, due to the oxidation and polymerization of hydrocarbon fuel, exhaust gas recirculation (EGR), positive crankcase ventilation (PCV) gases. It is believed that some of the unburnt hydrocarbons in the fuel undergoes complex cracking, polymerization and oxidation reactions, leading to reactive moieties which can interact with the fuel, recirculated gases and lubricating oils; thus forming insolubles in the combustion chamber and combustion pathways. These deposits, even when present in relatively minor amounts, often cause noticeable operational performance issues such as driveability problems including stalling and poor acceleration, loss of engine performance, increased fuel consumption and increased production of exhaust pollutants.

Fuel based detergents and other additive packages have been developed, primarily in gasoline fuels, to prevent the formation of these unwanted deposits. As a consequence, problems in fuel delivery systems, including injector deposit problems, have been significantly reduced. However, even after employing these detergent additives, injectors and other components require occasional additional cleaning to maintain optimum performance. The present additives and delivery devices are not completely successful eliminating deposits, especially for removing preexisting heavy deposits or deposits upstream of the fuel entry. Often these preexisting and upstream deposits require complete engine tear down. Attempts have been made to use higher concentrations of detergents and additives in the fuel but, since these detergents are mixed with the fuel, they are generally employed at concentrations less than 1% (primarily for compatibility with elastomers, seals, hoses and other components) in the fuel system. Moreover, for these detergent additives in the fuel to remove deposits from the various parts of an engine, they needed to come into contact with the parts that require cleaning.

Specific engine configurations have more pronounced problematic deposit areas due to the intake systems. For example, throttle body style fuel injector systems where the fuel is sprayed at the initial point of air flow into the system allows the intake to remain reasonably clean using the fuel additive, however port fuel injection spark ignition (PFI SI) engines spray the fuel directly into the air stream just before the intake valves and direct injection spark ignition (DISI) engines and many diesel engines spray the fuel directly into the combustion chamber. As a result, upstream components from the fuel entry on the intake manifold of PFI SI and DISI engines are subject to increased formation of unwanted deposits from oil, from the positive crankcase ventilation (PCV) system, and from exhaust gas recirculation (EGR) system. These upstream engine air flow components can remain with engine deposits even though a detergent is used in the fuel. Moreover, even with the use of detergents, some engine components when present, such as intake valves, fuel injector nozzles, idle air bypass valves, throttle plates, EGR valves, PCV systems, combustion chambers, oxygen sensors, etc., require additional cleaning.

Several generic approaches were developed to clean these problematic areas often focusing on the fuel systems. One common procedure is applying a cleaning solution directly to the carburetor into an open air throttle or the intake manifold of a fuel injection system, where the cleaner is admixed with combustion air and fuel, and the combination mixture is burned during the combustion process. These carburetor-cleaning aerosol spray cleaning products are applied from an external location into a running engine. The relatively slow delivery rate as well as the structure of the carburetor/manifold systems generally prevent the accumulation of cleaning liquid in the intake of the engine. However as is apparent for the intake manifold, the majority of the cleaner will take the path of least resistance to the closest combustion chamber of the engine often leading to poor distribution and minimal cleaning of some cylinders.

This technique has also been modified, to introduce a cleaning solution to the intake manifold through a vacuum fitting. Generally, these cleaning solutions are provided in non-aerosol form, introduced into a running engine in liquid form using engine vacuum to draw the product into the engine, as described in U.S. Pat. No. 5,858,942 issued Jan. 12, 1999. While these newer products may be generally more effective at cleaning the engine than the conventional aerosol cleaners, they suffer from a distribution problem in getting the cleaner to the multiple intake runners, intake ports, intake valves, combustion chambers, etc. Typically, the cleaning product was introduced into the intake manifold via a single point by disconnecting an existing vacuum line on the manifold and connecting a flex line from that vacuum point to a container containing the cleaning liquid and using engine vacuum to deliver the cleaning solution to that single port. While a metering device could be used limit the rate at which the cleaning solution was added to the intake manifold, the locations for addition of cleaning solution were fixed by the engine design of vacuum fittings on the intake manifold. Often such arrangements favored introduction of cleaning solution to some of the cylinders while others received less or none of the cleaning solution. More problematic is that some engine designs have an intake manifold floor, plenum floor or resonance chamber, which has a portion lower than the combustion chamber of the engine. This type of design will allow for a cleaning solution to pool in these areas. This aspect, as well as introducing the cleaning solution at too great a rate, can accumulate and pool the cleaning solution in the manifold even though the engine is running. Generally, the vacuum generated within the manifold is not sufficient to immediately move this pooled liquid or atomize the liquid for introduction into the combustion chamber. However, upon subsequent operation of the engine or at higher engine speed, a slug of this liquid can be introduced into the combustion chamber. If sufficient liquid is introduced into the combustion chamber, hydraulic locking and/or catastrophic engine failure can result. Hydraulic locking and engine damage can result when a piston of the running engine approaches its fully extended position towards the engine head and is blocked by essentially an incompressible liquid. Engine operation ceases and engine internal damage often results.

Accordingly, disclosed herein is an apparatus and application tool for introducing a cleaner composition into an operating reciprocating internal combustion engine, while providing discrete variable locations within the engine cavity for introduction of the cleaning solution. Such discrete locations can be within an intake vacuum system and/or independent of the engine vacuum port configuration. Thus, this device can be used to reduce or eliminate the possibility of pooling the cleaner solution into the intake manifold while allowing for improved distribution of the cleaner solution to affected areas.

Such an apparatus and application tool allows for rapid removal of engine deposits in reciprocating engines and is suitable for different engine types.

This apparatus and tool can be used in gasoline, diesel, and natural gas internal combustion engines and is especially suited for mounting inside the air intake manifold and used to deliver a cleaning composition to a discrete interior surface to be cleaned of a warmed up and operating internal combustion engine, thereby removing carbonaceous deposits.

SUMMARY OF THE INVENTION

This invention relates to a device for delivering a cleaning composition into a desired location within the interior cavity of a reciprocating internal combustion engine. The device has at least one orifice which is positionable to a specified interior location which is independent of the engine access ports.

In one embodiment, disclosed is an apparatus for administering a cleaning solution to an interior surface of a reciprocating engine system comprising an elongated conduit in fluid communication with a treatment manifold adapted for positioning into the interior of a reciprocating engine cavity through an access port, said treatment manifold having a bore therethrough and at least one maneuverable end portion having an orifice for directing fluid delivery to an interior surface of said engine requiring cleaning, wherein the treatment manifold is of sufficient length such that the orifice is positionable independently of the location of the access port, and a seal member circumscribing and in cooperation with said treatment manifold to releaseably engage with the access port of the engine.

In another aspect, the treatment manifold can have a plurality of orifices for delivering cleaning composition to discrete locations within the interior of the engine. Accordingly another embodiment is directed to an apparatus for delivering a cleaning composition to multiple independent interior surfaces of an engine system requiring cleaning comprising an elongated conduit in fluid communication with a treatment manifold adapted for insertion into the interior cavity of a reciprocating engine through an access port, said treatment manifold having a central bore in communication with a plurality of orifices disposed on said central bore and extending radially outward therefrom, said orifices positionable along the central bore to provide a plurality of discrete delivery points for substantially directing the cleaning composition to a plurality of preselected interior engine surfaces independent from the location of the access port, and a seal member circumscribing and cooperating with said treatment manifold to releaseably engage with the access port of said engine. In addition to the treatment manifold having a central bore the treatment manifold can comprise a plurality of tubes. Accordingly, another aspect comprises a treatment manifold having a plurality of independently directible tubes having a passageway therethrough and at least one orifice disposed on each tube for a discrete point of fluid delivery, said tubes having proximal and distal ends, wherein the proximal ends are in communication with a seal member, and at least one distal end of a tube positionable to a interior surface to be cleaned.

Another aspect of this invention is directed to an application tool employing the apparatus described herein above. Such an application tool is attachable to an air intake system of an internal combustion engine for administering and directing a cleaning composition to remove interior carbonaceous engine deposit comprising:

(a) a pressure resistant reservoir container having an inlet in communication with a pressure regulator and a discharge outlet, said container charged with an engine cleaning composition, (b) an adjustable valve connected to the discharge outlet of the pressure resistant reservoir container, (c) at least one elongated conduit having a proximal end and a distal end with a bore extending throughout, the proximal end being connectably attached to the adjustable valve for receiving engine cleaner composition discharged from the pressure resistant reservoir container upon actuation of the valve, (d) a treatment manifold in fluid communication with the distal end portion of the at least one elongated conduit, the treatment manifold adapted for insertion into the interior cavity of the engine through an access port within said engine, said treatment manifold having at least one directable tube with an orifice for fluid delivery extending within the interior engine cavity from the access port, a guide member concentric to a portion of the directable tube for positioning said orifice in proximity to a surface to be cleaned, (e) a seal member which is releasably engagible with the access port and cooperates with the elongated conduit and treatment manifold to allow for transport of fluid therethrough.

Among other factors, the present invention is based on the discovery that intake system deposits, particularly intake valve deposits, ridge deposits, combustion cylinder deposits, and combustion chamber deposits, can be effectively removed in reciprocating internal combustion engines by employing a cleaning composition and the unique apparatus and application tool described herein. Moreover, the apparatus of the present invention is suitable for use in removing specific interior deposits in conventional gasoline engines including conventional port fuel injection spark ignition (PFI SI) engines and in direct injection spark ignition (DISI)

gasoline engines. The present apparatus is especially suitable for use in DISI gasoline engines for removing problematic intake deposits. In another aspect, diesel engines and alternative fuel engines such as natural gas engines, including CNG and LPG engines, and hydrogen fueled engines can be cleaned using the present apparatus and application tool.

Deposit removal is not limited to certain type or class of engine as this apparatus and application tool allows for positionable interior delivery of a cleaning composition in close proximity to one or more problematic deposits and effectively removes deposits form a wide variety of two stroke and four stroke internal combustion engines such as PFI, DISI, diesel, marine, and natural gas engines and their accessories such as turbochargers, rotary and reciprocating pumps and turbines.

DETAILED DESCRIPTION OF THE INVENTION

Figure 1:
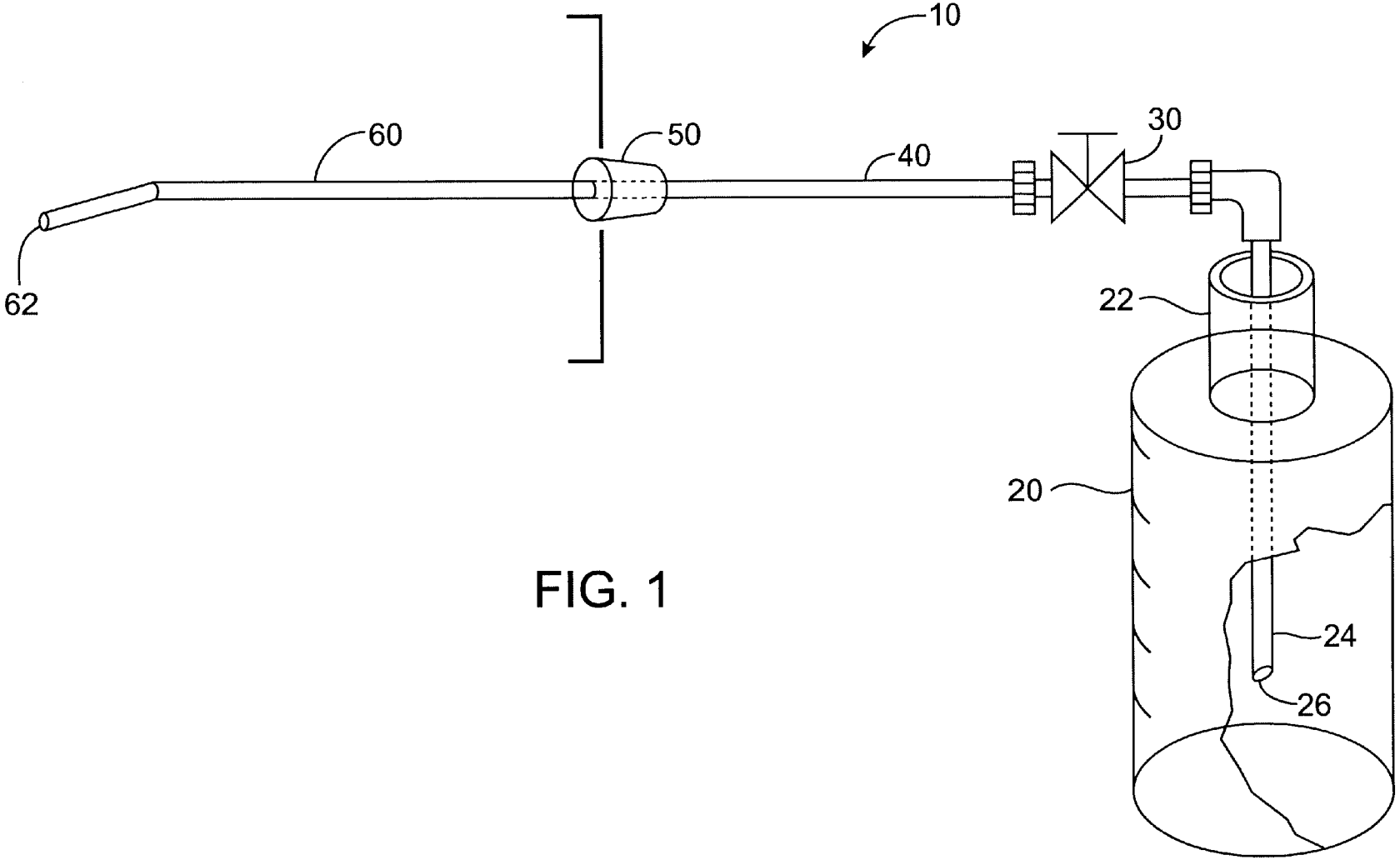
FIG. 1 illustrates the application tools for delivering cleaning compositions to discrete locations within an internal combustion engine requiring cleaning.

Carbon deposit build up inside internal combustion engines is a major source of customer complaints to manufacturers and service centers. These deposits often result in driveability problems, loss of engine performance and increased tailpipe exhaust emissions. New engine technologies, designed to deliver maximum fuel efficiency, are more susceptible to deposit build up. In particular, engines such as Direct Injection Spark Ignition (DISI) engines as well as modern diesel engines using high EGR ratio to achieve lower $NO_x$ emissions, form significant intake systems deposits, and will not benefit from fuel-based deposit control additives. The main reason being that in these engine environments, fuel is directly injected inside the combustion chamber and deposit control additives in the fuel will not have a significant impact on removing the critical intake system deposits. Additionally, deposit formation in gaseous fueled engines such as natural gas engines has been known to result in costly repairs. In response to these market opportunities, this invention is directed to an apparatus and application tool for use by a trained technician to administer a cleaning composition to a specified interior location of a reciprocating engine requiring deposit removal. The interior directablilty of the cleaning compositions allows for a greater fraction of these unwanted deposits to be removed in a short time, thus eliminating a significant fraction of the cost associated with disassembling the engine in order to physically remove these deposits.

Recently, direct injection spark ignition (DISI) engines have been introduced as an alternative to conventional port fuel injection spark ignition (PFI SI) engines. In the past few years, at least three types of DISI engines (from Mitsubishi, Toyota, and Nissan) have been commercially introduced into the Japanese market, and some models are now available in Europe and selected markets in Asia. Interest in these engines stems from benefits in the area of fuel efficiency and exhaust emissions. The direct injection strategy for spark ignition engines has allowed manufacturers to significantly decrease engine fuel consumption, while at the same time maintaining engine performance characteristics and levels of gaseous emissions. The fuel/air mixture in such engines is often lean and stratified (as opposed to stoichiometric and homogeneous in convention PFI SI engines), thus resulting in improved fuel economy.

Although there are many differences between the two engine technologies, the fundamental difference remains fuel induction strategy. In a traditional PFI SI engine, fuel is injected inside the intake ports, coming in direct contact with the intake valves, while in DISI engines fuel is directly introduced inside the combustion chamber. Recent studies have shown that DISI engines are prone to deposit build up and in most cases, these deposits are hard to remove using conventional deposit control fuel additives. Given that the DISI engine technology is relatively new, there is concern that with accumulated use, performance and fuel economy benefits will diminish as deposits form on various internal surfaces of these engines. Therefore, the development of an apparatus for internal precision delivery of an effective fuel detergents or "deposit control" additives and cleaning compositions thereof, to these internal adversely affected areas is of considerable importance.

In addition, advances have been made in diesel engines such as the use of low sulfur fuels, use of exhaust gas recirculation (EGR) and other engine treatment systems have tended to form more tenacious and difficult to remove deposits, while at the same time requiring higher levels of engine cleanliness for operation of these systems. The EGR and PCV gases, as well as blow back gases during valve overlap, contribute to intake system deposit formation; especially intake port and ridge deposits. These deposits can not be removed with fuel-based deposit control additives. As a result, a different approach to deposit removal is required in these engine technologies. DISI engines and gaseous fueled engines (e.g., natural gas engines) also require a similar deposit removal techniques and apparatus. Furthermore, increased reliance on alternative fuels such as hydrogen, natural gas and other hydrocarbon based fuels has also led to the need for new apparatus and to compositions for cleaning the resulting carbonaceous deposits due to the combustion of these fuels. This invention is directed at least in part to solving these problems by employing an apparatus to effectively deliver a cleaning composition to an internally deposited location independently of access locations on the engine. Also disclosed is an application tool employing this apparatus.

The application tool for delivering the additive components of a cleaning composition comprises: a container (either under atmospheric pressure or pressurized), a metering valve or orifice to control the flow rate of the additive composition, and a tube for uniform distribution of the product inside the intake system and ports. The essential component of the application tool is the delivery tube, referred to herein as a treatment manifold, which depending on the engine geometry could be fabricated from either rigid or flexible materials or can contain both. Delivery of the additive composition components via this tube could also vary. For example, the tube could be marked to allow traversing between different intake ports or it could have single or multiple holes or orifices machined along its length to eliminate the need to traverse. The application tool is suited for a variety uses and may be used to remove unwanted deposits from a variety of internal engine passageways. Particularly useful is the situation where the application tool is attachable to an air intake system of an internal combustion engine for administering and directing a cleaning composition to remove interior carbonaceous engine deposit comprising: a pressure resistant reservoir container having a discharge outlet, said container charged with an engine cleaning composition, an adjustable valve connected to the discharge outlet of the pressure resistant reservoir container, at least one elongated conduit having a proximal end and a distal end with a bore extending throughout, the proximal end being connectably attached to the adjustable valve for receiving engine cleaner composition discharged from the pressure resistant reservoir container upon actuation of the valve, a treatment manifold in fluid communication with the distal end portion of the at least one elongated conduit, the treatment manifold adapted for insertion into the interior cavity of the engine through an access port within said engine, said treatment manifold having at least one directable tube with an orifice for fluid delivery extending within the interior engine cavity from the access port, a guide member concentric to a portion of the directable tube for positioning said orifice in proximity to a surface to be cleaned, and a seal member which is releasably engagible with the access port and cooperates with the elongated conduit and treatment manifold to allow for transport of fluid therethrough.

In the case of a DISI engine, one such suitable access port within the engine cavity is a rail in communication with the intake runners; here, the tube is inserted inside the PCV (positive crankcase ventilation) rail. The additive composition components could then be either pressure fed or delivered under engine intake vacuum. The tube inserted inside the PCV rail will allow precise and uniform delivery of the additive composition upstream of each intake port for maximum deposit clean up efficiency.

The clean-up procedure is carried out in a fully warmed-up engine and while the engine is running at speeds ranging from manufacturer recommended idle speed to about 3000 RPM. The additive composition flow rate could be controlled to allow a wide range of delivery time. Flow rates ranging from about 10 to 140 ml/min are typically employed, although slower rates below 10 ml/min can be used as well.

In a conventional PFI SI engine, the tube is inserted inside the intake manifold or the intake system via a vacuum line. It is most preferred that the additive composition system gets delivered under pressure using the multiple hole design to achieve optimum distribution of the additive composition. The remainder of the procedures are similar to those described above for the DISI application.

A non-limitive example of a practice arrangement of the invention will be now described with reference to FIG. 1, which is a depiction of one such apparatus and application tool of this invention and be employed with the method described here for removing internal carbonaceous engine deposits. Although automotive engines are exemplified and used herein, the methods, apparatus and tool as well as their use are not limited to such, but can be used in internal combustion engines including trucks, vans, motorboats, stationary engines, etc. One embodiment is directed to engines capable of developing an intake manifold vacuum while running at or slightly above idle speeds. If the engine does not develop manifold vacuum, the apparatus could be pressurized to deliver the product, thus not relying on engine vacuum.

FIG. 1 illustrates the application tools for delivering the additive components to discrete locations within an internal combustion engine. The cleaning apparatus (10) includes a reservoir container (20) for holding the cleaning fluids. These fluids can be a cleaning composition, or a plurality of cleaning compositions applied sequentially. The reservoir can be square, cylindrical or of any suitable shape, manufactured of any chemically resistant material. Transparent or translucent materials are preferred in one aspect since an operator can easily ascertain the quantity and flowrate of fluid dispensed. Additionally, a graduated or otherwise marked reservoir can be utilized to aid in control of the fluid addition.

The reservoir container (20) has a neck (22) and optionally a fastening system such as a threaded cap, cork, plug, valve, or the like which can be removed or unjoined to provide a re-filling opening upon removal. Such fastening system also can have an integral vent to displace the fluid removed during operation. When the liquid is removed by the vacuum formed through engine suction, the vent can be an air vent and prevent a rigid container from collapsing. Alternatively, the vent could be attached to a pressure source. In such instance it is preferred that the reservoir container (20) be pressure resistant.

In one operation, the fluid is transferred from the container to the desired treatment location using the engine as the fluid motive force. Engine suction (i.e., vacuum generated by a running engine) is used to dispense the fluid in the reservoir container when the device is in operation and connected to a vacuum port of the engine. Even turbocharged engines which may operate at a supra-ambient intake manifold pressure under load at speeds above idle, may be cleaned using engine vacuum, since these operate with a manifold vacuum at speeds near idle when the engine is not under load. In another embodiment, an external fluid motive force can be applied which is further described herein.

The reservoir container (20) has a flexible or fixed siphon tube (24) extending downward terminating (26) towards the bottom of the container. In another aspect, the reservoir container can be inverted with a suitably sized siphon tube affixed to a capping means for fluid delivery, or in such instances the siphon tube may be eliminated from extending into the interior of the container. The inverted set-up can be assisted by gravitational forces. The siphon tube is in fluid contact with fluids held within the container. The siphon tube can be fixed to the wall of the reservoir container, fixed to the fastener system, or freely removable from the neck (22). The siphon tube, upon exiting the reservoir container, is connected to various fittings and optionally connected to an adjustable valve (30) or other flow metering means, useful for flow proportioning. The adjustable valve can comprise further elements such as an isolation valve which can be used to shut off the flow either before and/or after the adjustable valve, a flow switching means which can comprise separate valves and a tee, a two way directional valve, a multidirectional valve; and further coupled with flow controllers, restricted orifices, metering valves and the like to adjust flow proportioning depending upon the engine vacuum generated, the physical properties of the fluid to be delivered, the desired flowrates, etc. The adjustable valve ultimately is in communication with a flexible elongated conduit or hose (40) having the proximal portion attached to the siphon tube or the adjustable valve when present. The distal portion of the flexible conduit is connected to a treatment manifold (60) which is inserted inside the engine through an access port. Such an access port can either be created by the addition of a flange and accompanying structure created by the seal member (50) or by an intake air system element via a vacuum port or otherwise during operation. Typically if a point within the air intake is desired to be serviced, a plurality of access points are readily available which provide vacuum communication to other areas. For example, vacuum hoses may originate from the PCV, brake booster, manifold pressure sensor, EGR, distributor, charcoal canister purge port, etc. A seal member (50) having a fluid opening therethrough is located between the treatment manifold (60) and the flexible conduit to provide a vacuum seal with the engine while allowing the treatment fluids to flow to the engine. The degree of sealing required is dependent upon the engine control system.

In some larger engines, including large bore diesels and large bore natural gas engines, it may be preferred to modify engine system to provide such access. In these larger engines existing ports and for example the air intake manifold may not be suitably accessible to provide easy access to the components to be cleaned. The intake can be drilled or otherwise modified to provide a suitable pathway for introduction of the cleaning composition. After the cleaning procedure is completed, these new access ports can be plugged to maintain engine integrity. Similarly this modification can also be preformed on smaller engines, particularly when suitable access ports are not readily available.

In all instances, the treatment manifold allows for distribution of the cleaning composition(s) to discrete point(s) within the interior engine cavity, such as inside the intake system, runners and ports to thereby remove detrimental intake valve tulip deposits, ridge deposits and the like. The treatment manifold allows for interior positioning at, or proximate to, the point of the problematic deposit; to concentrate the cleaning effort at the point of the problem not relying on some other distribution system to carry the cleaner. The treatment manifold can be used to pinpoint and direct a cleaning composition to a specified area within the interior of an engine cavity and thus deliver a substantial portion of the cleaning composition to a deposited location. This treatment location is independent of the location of the access port and beneficially does not flush contaminates from the access port location (downstream) to the deposit; thus in effect, exacerbating the deposits desired for removal.

The treatment manifold is designed depending upon the engine type, geometry and available engine access including vacuum ports and intake ports as well as connectors. Accordingly, the treatment manifold may be rigid or flexible, constructed of suitable materials compatible with the cleaning fluids and engine operating conditions. However, the treatment manifold is sized with the constraints that the treatment manifold enters and is located within the engine cavity. Nonlimited locations for insertion include the air intake opening, vacuum port openings, such as PCV ports, brake booster ports, air conditioning vacuum ports, drilled access ports, etc. Delivery of the cleaning compositions via this treatment manifold can also vary. For example, the treatment manifold can have a single opening or orifice for fluid delivery, having optional marking indicative of intake port location and allow for traversing between different intake ports such as: the A and B ports on a multi-valve engine, or a common A/B port leading to a single combustion chamber, or for traversing to intake ports which lead to different combustion chambers. This maneuverability allows the treatment manifold to be placed a position substantially adjacent to an interior surface of the engine to be cleaned. The treatment manifold is of sufficient length to be independent of the location of the access port and has a maneuverable end portion proximate to the orifice for directing fluid to the problematic area. Alternatively, the treatment manifold can contain multiple holes or orifices machined along its length. These multiple orifices can be of differing sizes to improve distribution at one or more locations. Multiple orifices can also serve to reduce or eliminate the need for such traverse. The location of the orifices can correlate to the inlet runners, thereby achieving optimal distribution of the cleaning composition. In another aspect, the treatment manifold can have a plurality of independently directable tubes equipped with an orifice for delivering the cleaning composition.

The treatment manifold has a maneuverable end portion proximate to the orifice for directing fluid to the problematic area. In the simplest aspect, this maneuverability and traverse can be accomplished by releaseably engaging the seal member circumscribing the treatment manifold and manually repositioning the treatment manifold to a new location after which the seal member is reengaged. For example, if the treatment manifold is extended to the furthest location inside the engine, a new position could be maneuvered by releasing the seal member and removing a portion of the treatment manifold that was located inside the engine, the seal is then re-engaged and cleaning solution is as before transferred by the elongated conduit which now may be a longer length. Alternatively, the treatment manifold can be removed and cut to size. The positioning of the treatment manifold can be manually advanced or withdrawn by an operator by grasping the elongated conduit and rotating and/or manipulating the treatment orifice to the desired location.

Alternatively, this positioning can be automated. The treatment manifold may have a telescopic movement for traversing the engine cavity. This can be rigid, such as nested concentric segmented portions each in communication with the adjacent member extending further into the engine cavity; or by a flexible construction by folding excess material back on itself or in an accordion like fashion; or by using a rigid guide member in conjunction with a flexible end portion extending therethrough. The distal end of the treatment manifold can be positioned by a wide variety of methods. In one aspect, an external force such as a strong magnet can be used to position the distal end. In such application the end portion is constructed of a ferrous material and directed along the desired path by movement of the external magnet. An external fluid can be used to extend the telescopic movement, such a treatment manifold generally has a cylindrical housing having a distal cylindrical portion to which an outer wall is securely attached. This wall is folded back upon itself to form an expandable distal end and form an inner tubular wall which is fan folded and telescoped within the cylindrical housing to form a proximal end near the seal member. The inner wall forms an interior passageway therethrough and an expandable exterior cavity. A gas or fluid inlet is connected and in communication with the exterior cavity and when introduced under pressure the expandable distal end is extended outward thus, the resulting distal end and orifice of the treatment manifold can be positioned to its appropriate location by telescopic movement.

In another aspect the distal portion of the treatment manifold is attached to one or more cables which is in communication with a handheld exterior control unit. A control mechanism is operatively connected to an operating cable to deflect the distal portion of the treatment manifold having a flexible body portion and at least a flexible tip portion on the distal end. The control mechanism is adapted to control the magnitude of tensile force developed in the operating cable. Preferably the distal portion is fitted with an integrated four cable system attached to a control mechanism having at least two knobs used to manipulate side to side movement and up and down movement. Optionally, the distal portion can be coupled to a fiber optic imaging bundle with one or more illumination fibers extended exterior of the seal member. Additionally, this can be configured with a miniaturized video camera, such a CCD camera, which transmits images to a video monitor by a transmission cable or wireless transmission.

The treatment manifold can also consist of multiple tubes attached to flexible conduit where the tubes can be directed dependently or independently to the desired treatment location either through the same or different vacuum points at the engine intake manifold. These multiple tubes can have holes or orifices machined along their length to dispense fluids to a single or to multiple intake ports. The multiple tubes can be constructed of various internal diameters to compensate for the variable vacuum motive force and flow profile at the various orifices. To aid in distribution of the fluid from the open tube orifices, the distal portion of the tube can be optionally fitted with a nozzle to produce a fog or otherwise improve spray distribution.

Figure 2:
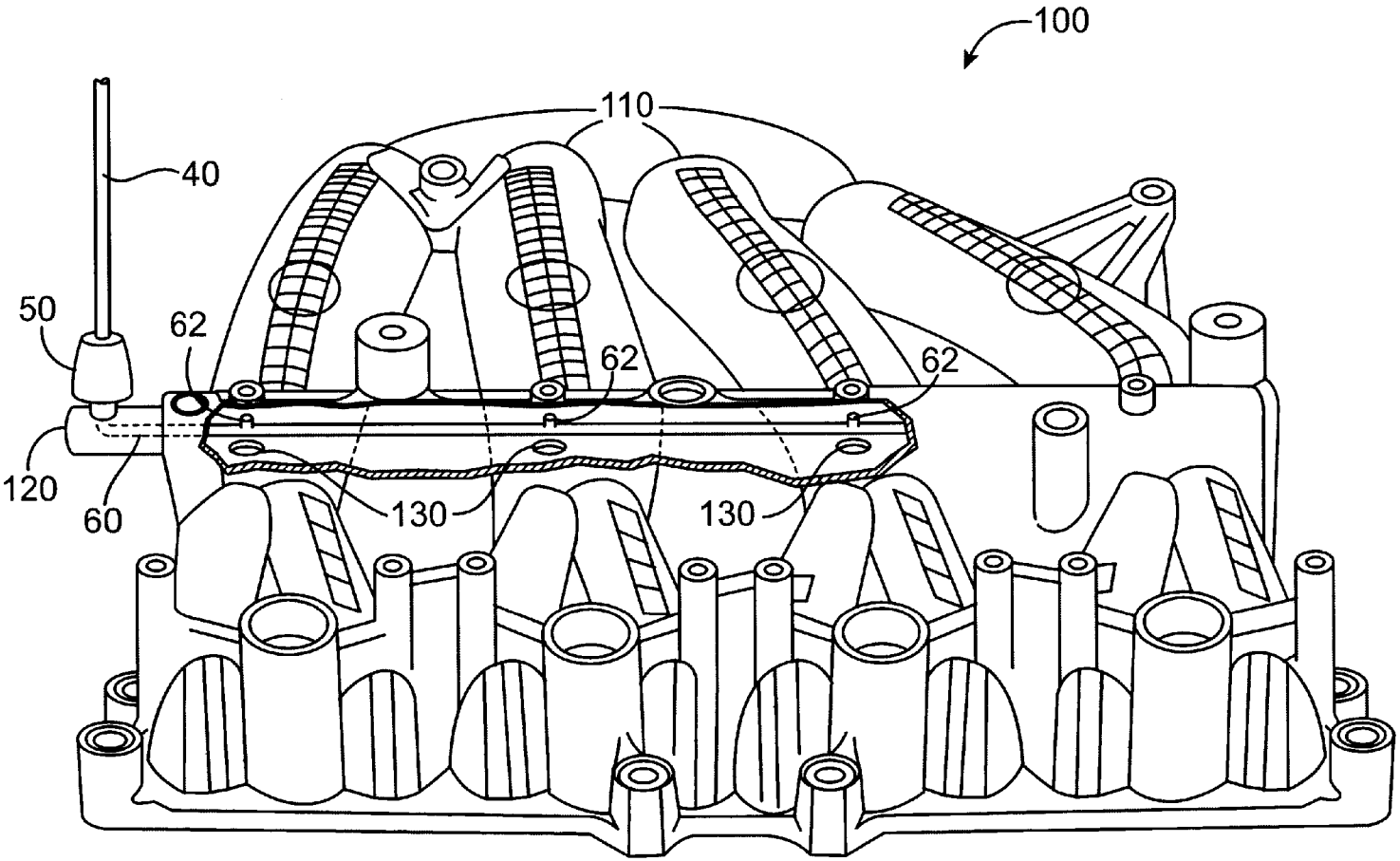
FIG. 2 illustrates a multi-port apparatus for introducing cleaning compositions into the interior cavity of an engine to be treated.

FIG. 2 is illustrative of a multi-port apparatus for introducing cleaning compositions into the interior cavity of an engine to be treated. Said engine (not shown) has an air intake manifold (100) for supplying combustion air to the combustion chamber (not shown). For multi-port engines the air intake manifold (100) can have a plurality of intake runners (110) leading from the air intake to the combustion chamber. The air intake manifold may also have various access points such as the throttle body, vacuum ports, PCV ports, as well as other connections which are of suitable size to allow for insertion of the transport means, exemplified by the treatment manifold (60), inside the engine cavity. One such port is a PCV rail or PCV port (120) which is in communication with at least one intake runner (110). As illustrated in FIG. 2, this communication is through an open orifice (130) from the PCV rail to the intake runner(s). A treatment manifold (60), having a plurality of orifices (62) is inserted into the PCV rail (120) where optionally, the orifices on the treatment manifold correlate to the orifices on the PCV rail. If necessary, this treatment manifold can traverse the PCV rail. The treatment manifold (60) is in fluid communication with an elongated conduit (40) which leads to a reservoir (not shown) containing a cleaning fluid to be delivered. In the junction between the elongated conduit (40) and the treatment manifold (60) is a seal member (50) within the PCV rail or having at least one surface on the exterior of the engine to serve as a plug and in this instance allow for engine vacuum to draw the cleaning composition from the reservoir container.

In operation, the apparatus of this invention (10) can be mounted in any suitable location in proximity to the engine to be treated. A suitable passageway position for the introduction of the treatment components within the air intake manifold is selected for the particular engine and in regard to the specific treatment manifold. For example, for the 1998 Mitsubishi Carisma equipped with a 1.8 L DISI engine, this DISI engine has a PCV rail accessible to the B ports of the intake valves. However, other engines with PCV valves in communication with an internal crankcase chamber of the engine to a PCV fitting on the air intake manifold could serve this purpose. Other locations identified but not preferred in this particular engine were the air inlet and the brake vacuum line. However, these may be preferred in other engines. To set up the apparatus, the engine hose connecting the PCV system is disconnected and the treatment manifold is inserted within this PCV rail with the remainder of the rail opening sealed by the sealing member (50). The cleaning procedure is preferably carried out on a fully warmed engine and while the engine is running at engine speeds ranging from the manufacturer recommended idle speed to approximately 3000 revolutions per minute (RPM). The cleaning composition is then introduced to the discrete engine locations requiring treatment via the treatment manifold. Some applications may require traverse of the manifold. If subsequent cleaning compositions are to be used, they are introduced in like fashion. The apparatus can be pre-calibrated to achieve the desired flowrate or field calibrated during operation. Additionally, such calibration and traverse can be automated. In a DISI engine, the intake portion from the PCV valve to the combustion chamber does not have contact with the fuel and tends to have increased engine deposits on the intake valves. As exemplified herein, the method and apparatus of this invention are directed to providing a solution to this issue.

The above apparatus and application tool was defined using engine vacuum generated within the air intake manifold as the fluid motive force. However, in a preferred aspect, the cleaning compositions can be introduced using a modified apparatus having an external pressure source to transfer the cleaning solution into the engine. This external pressure source can be a pressurized aerosol container, a pressurized gas (compressed air, nitrogen, etc.) or, alternatively, a pump can be connected in communication between the siphon tube (24) and the flexible conduit (40). Suitable pumps for delivering and metering fluid flow are known in the art. Suitable pressurized systems are also available in the art and, for example, are described in U.S. Pat. Nos. 4,807,578 and 5,097,806; both incorporated herein by reference in their entirety. Generally, pressurized systems can lead to construction of components having smaller sized dimensions including thinner conduits that need to be placed within the engine (i.e., treatment manifold (60) or other transfer conduits). Additionally, pressurized system can offer opportunities for increased fluid control at the manifold orifice(s) (62). For example, these orifice(s) could be fitted with pressure compensating valves, flow restrictors, and various nozzles to improve the distribution of cleaning compounds.

Aerosol pressurized systems are defined by having an aerosol container containing the cleaning composition which can be put into fluid communication with the treatment manifold (60). Pressurized gas systems use a regulated gas in contact with a pressure container containing the cleaning composition, wherein the pressurized gas displaces the fluid to a discharge end which is in fluid communication with the treatment manifold. Both of these systems can optionally contain a pressure regulator, flow valve, filter and shut off valve which can be configured to deliver the cleaning compositions to the desired engine treatment areas, as defined in the above apparatus. One suitable pressurized gas system (illustrated in part in FIG. 3) is supplied by pressurized air, typically shop air, from an air supply source (200) via a supply hose (201). The pressurized air assists in direction the cleaning composition through the elongated conduit (240) releasably attached to the seal member (250) and in fluid communication with the treatment manifold (260) to exit at the orifice(s) (262). The pressurized gas system includes a regulator which communicates with the supply hose and more specifically the first end of the supply hose can be attached to the air supply source and the second end of the hose can be connected to the regulator, such fitting can be quick disconnects. The regulator is equipped with an adjustment knob, used to vary and control the air pressure and air flow into the pressure resistant reservoir, and a gauge used to measure the air pressure in the system. The regulator communicates with the main body of the reservoir through a check valve located on a top portion of the reservoir. The top portion can be secured to the main body utilizing inter-fitting threads and optionally a gasket such as an o-ring. Affixed to the top portion is a vent cap equipped with a pressure relief valve which may be opened to bleed off pressure within the body section. Also affixed to the main body and preferably the top portion, is a siphon tube directed in the interior cavity of the main body and in fluid contact with the cleaning composition to be delivered. The siphon tube exits the main body via an outlet which is attached to a fitting and in communication with a check valve. Downstream of the check valve is a tee with one passageway attached to a gauge, used to indicate the fluid pressure of the cleaning composition ultimately administered, and the other passageway of the tee connected to an isolation valve which can prevent the flow of cleaning composition to the elongated conduit and ultimately the treatment manifold and orifice(s).

Figure 3:
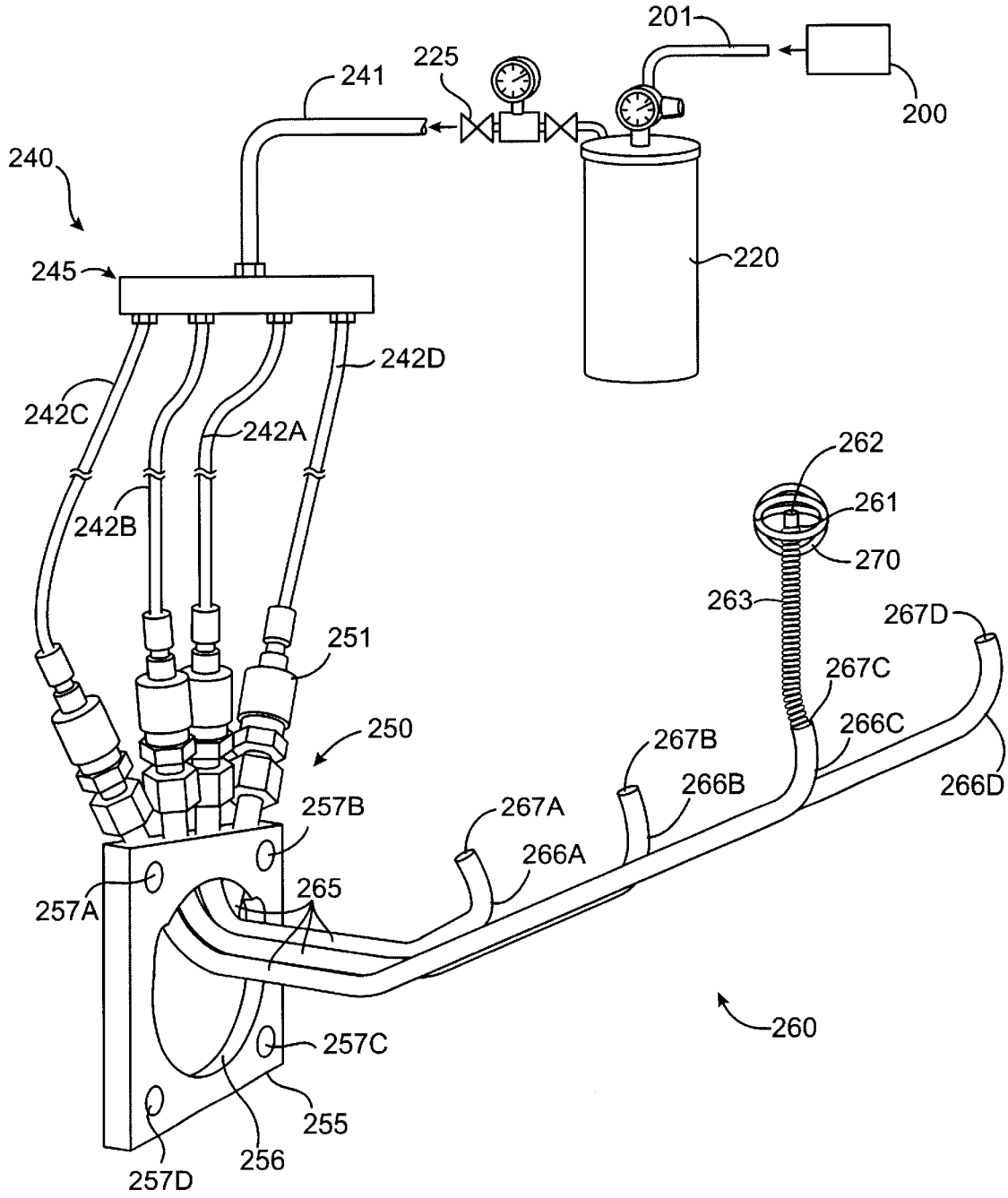
FIG. 3 illustrates a multi-port and internal multi-runner configuration apparatus and pressurized application tool.

FIG. 3 is illustrative of a multi-port and internal multi-runner configuration apparatus shown as a pressurized application tool. This apparatus can be used for delivering a cleaning composition to an interior surface of a engine system comprising an elongated conduit in fluid communication with a treatment manifold adapted for insertion into the interior cavity of a reciprocating engine through an access port, said treatment manifold having a plurality of independently directible tubes having a passageway therethrough and at least one orifice disposed on each tube for a discrete point of fluid delivery, said tubes having proximal and distal ends, wherein the proximal ends are in communication with a seal member, and at least one distal end of a tube positionable to a interior surface to be cleaned. Several of the components of FIG. 3 have been previously described in reference to earlier figures however, for the sake of clarity new reference numbers are used herein. FIG. 3 is illustrated with a pressurized gas system used as a motive force to deliver the cleaning composition from the reservoir, preferably a pressure resistant reservoir, through the apparatus and to a preselected interior cavity of a reciprocating engine requiring cleaning. However, as stated above, engine vacuum can also be used to administer cleaning composition from the reservoir to the engine.

In reference to FIG. 3, the pressure resistant reservoir (220) is pressurized by a pressure source (200) through a supply line (201) which is controlled by a regulator. The supply line can be connected via quick disconnects that includes male and female members that inter fit. Typically, a one way (i.e. check) valve in line opens when the quick disconnect members are inter-fitted, and closes when the members are separated, whereby pressure is maintained in the supply line to the pressure source. The pressure resistant reservoir (220) has a discharge outlet, often attached to a gauge, in communication with an adjustable valve (225). The valve can be used in flow proportioning or as a shut off to interrupt the flow the cleaning composition. The adjustable valve is in communication with an elongated conduit (240) which enables transport of the cleaning composition from the reservoir through the seal member (250) and to the treatment manifold (260). More specifically as illustrated in FIG. 3, the communication from the adjustable valve is from a connection, preferably a quick connection, to a supply hose (241) where the other end of the supply hose is attached to a splitter (245). The splitter is particularly useful when the treatment manifold (260) has a plurality of independently directible tubes and allows for flow proportioning to each of the independently directible tubes. The splitter has at least one discharge end and preferably as many discharge ports as the number of directable tubes. However, unused discharge ports can be suitably capped and in the event that only a single port is used the splitter functions effectively as a connector between the supply hose (241) and a transfer conduit (242*a–d*), preferably using a quick disconnect. The transfer conduit is in communication from the splitter (245) to the seal member (250) through a coupling on the seal member, namely the tube seal (251). The seal member (250) is releasably engagable with an access port of an engine to be serviced and allows for a pathway that the treatment manifold (260) to be introduced to the interior cavity of the engine. Thus, the seal member often demarks a transition from the interior to the exterior of the engine. As such the seal member can have an external surface (255) to the engine to be serviced and an internal surface (256) and can function as a flange to provide a convenient access port. A particularly preferred location for this flange is within the air intake manifold and preferably where the flange is adapted for positioning downstream of the throttle plate. Downstream in this instance refers to the movement of combustion air as it passes through the engine. The flange can be mounted adjacent to the throttle plate assembly and preferably, mimics the mounting strategy of the throttle plate, for example bolt holes (257*a–d*) line up with the bolt holes mounting for the throttle plate. In operation, the throttle plate assembly can be removed while the seal member is positioned in place with the treatment manifold located in the interior engine cavity, and then the throttle assembly can be reattached thus mating with the seal member. The tube seal (251) may be integral to the seal member or affixed thereto, and provides a seal between the transfer conduit and access port of the engine. The tube seal engages the transfer conduit and provides for a substantially vacuum tight fitting between the interior engine cavity and exterior portion of the engine. Preferably the tube seal is releasable and re-engagable to the treatment manifold.

The treatment manifold (260) is located in the interior portion of the engine cavity and has a maneuverable end portion with a terminal portion having an orifice (262) for providing discrete location(s) for cleaning composition delivery within this interior engine cavity and which is positionably independently of the access port of the engine. As illustrated in FIG. 3, the treatment manifold (260) can further comprise a guiding member (265) which is in communication with the seal member (250) and provides a passageway for a flexible tube (261) with a distal end portion that ultimately delivers the cleaning composition via the orifice (262). The guiding member is of sufficient rigidity to assist in positioning the maneuverable end portion in closer proximity to the desired location in need of treatment, but with the size constraints that it allows the treatment manifold to fix inside the engine interior through the access port. Generally, a smaller profile is preferred. When a rigid guiding member (265) is employed it can be prefabricated to maintain a bend (266*a–d*) having an end portion (267*a–d*) used to change direction of the tube (261) in accordance with the engine design. For example the guiding member can be of sufficient length and with a sufficient bend, based upon engine design, that the maneuverable end portion can be extended into individual intake runners and can be proximate to the intake ports. The tube (261) is selected to have sufficient flexibility to be threaded and directed by the guiding member and chemically compatible with the cleaning composition to be delivered. In the event that the tube has too high a degree of flexibility so that it folds back upon itself or cannot be adequately positioned, the tube can be clad by a more rigid guiding tube (263). The cladding can be any suitable material and in one instance is selected to be a spring with a suitable spring constant so that it is directable within the guiding member (265) but due to the bend (266*a–d*) of the guiding member in cooperation with the spring, the orifice (262) can be positioned closer to the desired location within the interior cavity of the engine. Optionally attached to the guiding tube (263) or tube (261) is a positioning member (270) securely attached thereto. The positioning member allows the orifice (262) to maintain a separation from the interior surface of the engine at the point of discharge. Depending upon the size, shape and configuration of the passageway that the tube is directed, often it is desirable to maintain a separation between the orifice and the interior surface at the point of discharge. Contact with the interior wall at this point can adversely effect discharge flow patterns and can increase the possibility of capillary action and back flow of cleaning composition along the exterior portion of the tube and along exterior wall portions, in an undesired direction. The positioning member (270) can be of any geometry which allows for dimensional positioning. Suitable shapes include a sphere, ellipse, parallelogram, triangle, three prongs, etc. The positioning member (270) can be collapsible or sized to fit within the guide member (265); alternatively, the positioning member can traverse and be in contact with the end portion (267*a–d*) for introduction and withdrawal of the treatment manifold (260). The end portion (267*a–d*) can be keyed with the guiding tube (or tube 261) to prevent rotation and maintain a preselected position of the orifice within the engine cavity. Suitable keyways include slots in the end portion, flattened ends or other geometric constraints such as triangular, square etc. members. Keyways are particularly useful when the positioning member (270) is located at a Y in the passageway (i.e. a split) and the discharge orifice (262) also terminates in a Y (plurality of orifices). In such instance, the keyway can assure proper orientation to maximize fluid administration.

Figure 4:
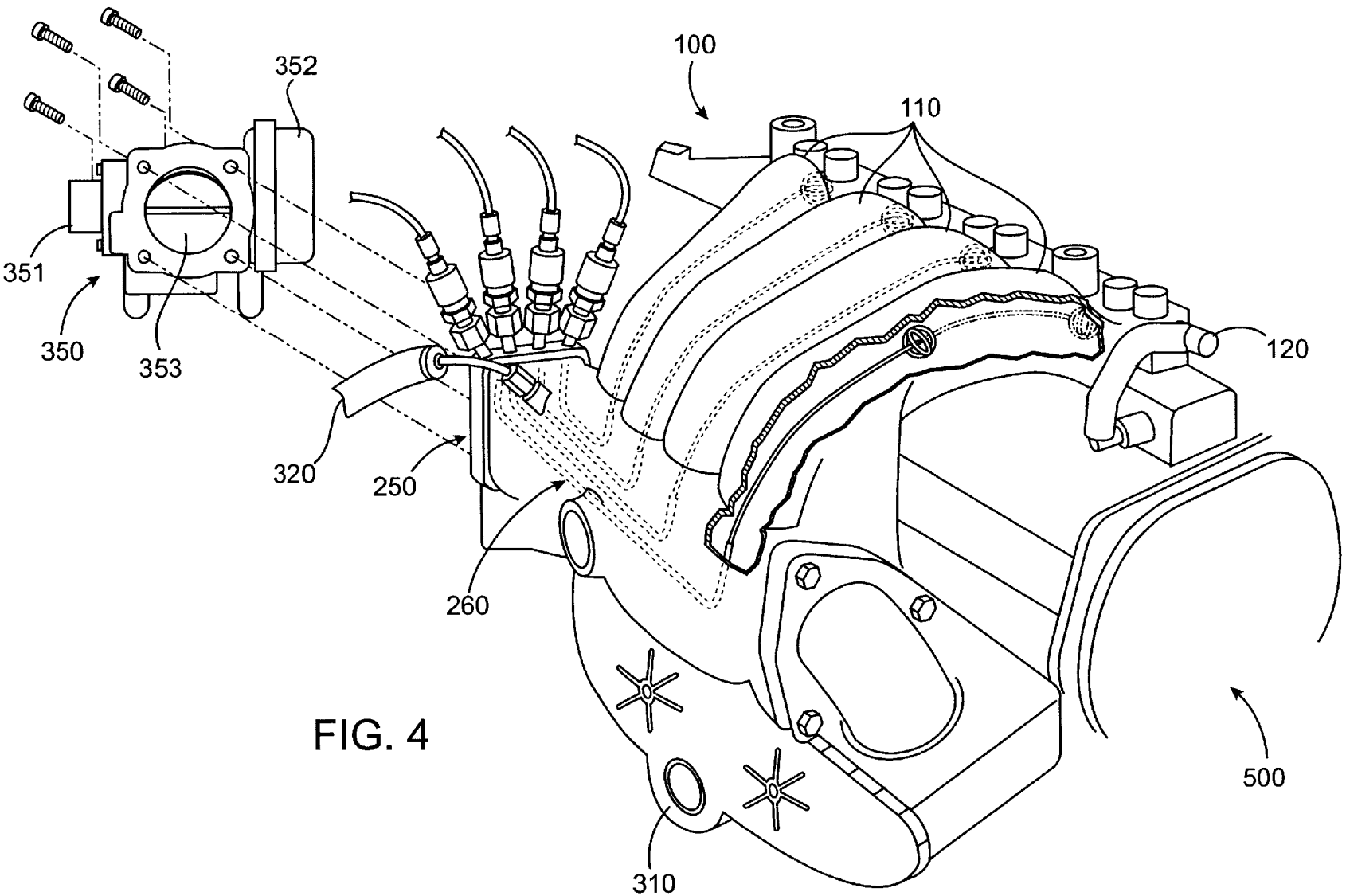
FIG. 4 is a schematic of a multi-port apparatus positioned inside the intake system of a reciprocating internal combustion engine.

FIG. 4 illustrates the positioning of the treatment manifold (260) inside the interior cavity of a reciprocating engine to be treated, and in the present instance the treatment manifold is in communication with the air intake manifold and downstream of the throttle plate. As such, FIG. 4 illustrates a portion of the engine (500) focusing primarily on the air intake system including the intake runners (110) and resonator (310). The resonator is open to the air intake manifold and provides a cavity to dampen fluxuations in the combustion air properties. As previously stated, the resonator can also provide an undesirable accumulation area for pooling the treatment compositions administered. One aspect of this invention is to decrease the likelihood and prevalence of pooling cleaning compositions in the manifold plenum floor and/or resonator by use of the treatment manifold (260).

As illustrated in FIG. 4 the throttle plate assembly (350) is removed from the intake manifold (100), in the present instance, this is accomplished by removing the mounting bolts and removing the throttle plate assembly from the inlet of the intake manifold. This particular throttle plate assembly has a throttle plate (353) which can open and close by means of a motor or other actuator (352) and its position noted by a throttle positioning sensor (351), other throttle plate assemblies and control systems are known in the art. The throttle plate assembly is coupled with the engine control system and through positioning the throttle plate (open to closed) regulates the amount of air passing unto the combustion chambers. After the throttle plate is removed from the engine to be serviced, the treatment manifold can be inserted into the engine through the open access area. Preferably, the orifice (262) of the treatment manifold is fully retracted within the treatment manifold upon insertion into the engine and preferably within the guide member when so equipped. Retraction of the orifice, as well as the delivery tube, cladding and/or positioning member, if so equipped, allows for easier initial positioning of the treatment manifold. After positioning the treatment manifold within the engine cavity the seal member is placed in cooperation with the treatment manifold and access port, to releasably engage the engine access port. In FIG. 4, the seal member (250) is flange-shaped and sandwiched between the throttle plate assembly and the throat of the intake manifold. Preferably the mounting means employed by the throttle plate assembly is also used by the seal member. After the seal member is positioned, the throttle plate is returned to be in communication with the intake manifold and the engine can be operated without additional modification. The positionable orifice of the treatment manifold, if desired, can be further positioned within the intake manifold. Suitable means for traverse are described herein above. A particularly preferred area for positioning the orifice is in close proximity to an area desirable to be cleaned; thus cleaning composition can be delivered substantially to a desired interior engine location One such preferred area, for example is the air intake access port(s). As disclosed above there are other numerous access points for administering a treatment manifold tube. In another aspect, a treatment manifold with a guiding member can be coupled with another manifold tube at a different location for independent delivery. Suitable locations depicted in FIG. 4 are the brake vacuum port (320) or the PCV rail (120). A single cleaning composition or multiple cleaning solutions can be administered by the apparatus such as sequential addition. Alternatively, multiple tubes can different cleaning compositions even within the same intake runner or if so equipped within the same guide member. Such compositions can be chemically reactive and be directed to react at a predetermined location within the interior of the engine.

The present apparatus is suitable for delivering cleaning compositions of different viscosity as well as other physiochemical properties. Components such as the reservoir, elongated conduit, treatment manifold, tube, orifice, and other components in fluid contact with the cleaning composition are selected to be chemically compatible. Other components not in direct fluid contact with the cleaning composition can be made of a variety of materials, including metals, plastics, ceramics and other composites.

Suitable Cleaning Solutions

A wide variety of carburetor cleaners and engine deposit cleaners including fuel based additives are known in the art and suitable for use with the present invention. Preferably the cleaning composition comprises a nitrogen containing detergent additive and a carrier including alcohols, esters, ethers, aliphatic or aromatic solvents, cyclic carbonates, or mixtures thereof. A particularly preferred cleaning composition is described herein and comprises a first solution mixture and a second solution mixture (detailed below) which was developed and tested in a wide variety of internal combustion engines to quickly and effectively remove deposits from critical internal surfaces of these engines. Such a deposit removal application is not limited to certain type or class of engines as this cleaning composition will effectively remove deposits from a wide variety of two stroke and four stroke internal combustion engines such as PFI, DISI, diesel, marine, and natural gas engines and their accessories such as turbochargers, rotary and reciprocating pumps and turbines.

In one embodiment, the method of the present invention comprises introducing a cleaning composition into an air-intake manifold of a previously warmed-up and idling reciprocating internal combustion engine and running the engine while the cleaning composition is being introduced by the application tool of this invention. A preferred cleaning composition comprises a first and second solution. The first solution comprises a mixture of (a) a phenoxy mono- or poly(oxyalkylene) alcohol, (b) at least one solvent selected from (1) an aliphatic alcohol, and (2) an aliphatic or aromatic organic solvent, and (c) at least one nitrogen-containing detergent additive. The second solution comprises a mixture of (d) a phenoxy mono- or poly (oxyalkylene) alcohol, (e) a cyclic carbonate, and (f) water. The components of the cleaning solution are further defined below.

The Phenoxy Mono- or Poly(oxyalkylene) Alcohol

The phenoxy mono- or poly(oxyalkylene) alcohol component of the cleaning composition employed in the present invention has the following general formula:

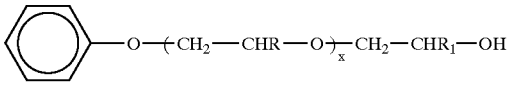

(I)

wherein R and $R_1$ are independently hydrogen or methyl and each R is independently selected in each —$CH_2$—CHR—O— unit; and x is an integer from 0 to 4; and mixtures thereof.

In Formula I above, R and $R_1$ are preferably hydrogen and x is preferably an integer from 0 to 2. More preferably, R and $R_1$ are hydrogen and x is 0.

Suitable phenoxy mono- or poly(oxyalkylene) alcohols for use in the present invention include, for example, 2-phenoxyethanol, 1-phenoxy-2-propanol, diethylene glycol phenyl ether, propylene ethylene glycol phenyl ether, dipropylene glycol phenyl ether, and the like, including mixtures thereof. A preferred phenoxy mono- or poly(oxyalkylene) alcohol is 2-phenoxyethanol. A commercial 2-phenoxyethanol is available from Dow Chemical Company as EPH Dowanol.

The Solvent

The solvent component of the cleaning composition employed in the present invention is at least one solvent selected from (1) an aliphatic alcohol, and (2) an aliphatic and/or aromatic organic solvent. More than one solvent can be employed in the formulation such as mixtures of aliphatic alcohols, mixtures of aliphatic organic solvents, mixtures of aromatic solvents. At least one solvent also includes mixtures of aliphatic alcohol(s) with aliphatic organic solvent (s), mixtures of aliphatic alcohol(s) with aromatic organic solvent(s), mixtures of aliphatic alcohol(s) with aliphatic organic solvent(s) and aromatic organic solvent(s), and well as mixtures of aliphatic organic solvent(s) with aromatic organic solvent(s).

1. The Aliphatic Alcohol

The aliphatic alcohols are selected from an aliphatic or aryl-substituted aliphatic alcohol having a total of 4 to 30 carbon atoms. The aliphatic alcohol includes linear or branched chain aliphatic groups and can form primary, secondary and tertiary alcohols. Preferably the aliphatic alcohols contain from 6 to 20 carbon atoms and most preferably from 7 to 15 carbon atoms. The aliphatic alcohols can be substituted with aryl groups of 6 to 9 carbon atoms and more preferred is a phenyl group. Preferred are lower alcohols are octyl, decyl, dodecyl, tetradecyl, hexadecyl, as well as branched chain alcohols etc. Especially preferred is ethyl hexanol and more particularly 2-ethyl hexanol.

The alcohols can be mixtures of molecular weights and of various chain branching. Examples of commercially available primarily linear alcohols include Alfol 810 (a mixture of primarily straight chain, primary alcohols having from 8 to 10 carbon atoms); Alfol 1218 (a mixture of synthetic, primary, straight-chain alcohols containing 12 to 18 carbon atoms); Alfol 20+ alcohols (mixtures of $C_{18}$–$C_{28}$ primary alcohols having mostly $C_{20}$ alcohols as determined by GLC (gas-liquid-chromatography)); and Alfol 22+ alcohols ($C_{18}$–$C_{28}$ primary alcohols containing primarily $C_{22}$ alcohols). Alfol alcohols are available from Continental Oil Company.

Suitable branched alcohol(s) may be selected from the following group: tert-amyl alcohol, 2-methyl-1-butanol, 3-methyl-1-butanol, neopentyl alcohol, 3-methyl-2-butanol, 2-pentanol, 3-pentanol, 2,3-dimethyl-2-butanol, 3,3-dimethyl-1-butanol, 3,3-dimethyl-2-butanol, 2-ethyl-2-butanol, 2-hexanol, 3-hexanol, 2-methyl-1-pentanol, 2-methyl-2-pentanol, 2-methyl-3-pentanol, 3-methyl-1-pentanol, 3-methyl-2-pentanol, 3-methyl-3-pentanol, 4-methyl-1-pentanol, 4-methyl-2-pentanol, 2-(2-hexyloxyethoxy)ethanol, tert-butyl alcohol, 2,2-dimethyl-3-pentanol, 2,3-dimethyl-3-pentanol, 2,4-dimethyl-3-pentanol, 4,4-dimethyl-3-pentanol, 3-ethyl-3-pentanol, 2-heptanol, 3-heptanol, 2-methyl-2-hexanol, 2-methyl-3-hexanol, 5-methyl-2-hexanol, 2-ethyl-1-hexanol, 4-methyl-3-heptanol, 6-methyl-2-heptanol, 2-octanol, 3-octanol, 2-propyl-1-pentanol, 2,4,4-trimethyl-1-pentanol, 2,6-dimethyl-4-heptanol, 3-ethyl-2,2-dimethyl-3-pentanol, 2-nonanol, 3,5,5-trimethyl-1-hexanol, 2-decanol, 4-decanol, 3,7-dimethyl-1-octanol, 3,7-dimethyl-3-octanol, 2-dodecanol, and 2-tetradodecanol.

Examples of commercially available branched chain primary alcohols can be produced by catalytic hydroformation or carbonylation of higher olefins feed stocks, as an example "EXXAL 12" dodecyl alcohol available from ExxonMobile is a mixture of $C_{10}$–$C_{14}$ primary alcohols. Suitable Exxal alcohols include Exxal 7 through Exxal 13, and include isoheptyl, isooctyl, isononyl, decyl, nonyl, dodecyl and tridecyl alcohols. These commercial mixtures of branched alcohols such as the following alcohols are Exxal 7 (a mixture of branched heptyl alcohols), Exxal 8 (a mixture of branched octyl alcohols), Exxal 9 (a mixture of branched nonyl alcohols), Exxal 10 (a mixture of branched decyl alcohols), Exxal 11 (a mixture of branched nonyl alcohols), Exxal 12 (a mixture of branched dodecyl alcohols), and Exxal 13 (a mixture of branched tridecyl alcohols).

Another example of a commercially available alcohol mixtures are Adol 60 (about 75% by weight of a straight chain $C_{22}$ primary alcohol, about 15% of a $C_{20}$ primary alcohol and about 8% of $C_{18}$–$C_{24}$ alcohols) and Adol 320 (oleyl alcohol). The Adol alcohols are marketed by Ashland Chemical. Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols. A variety of mixtures of monohydric fatty alcohols derived from naturally occurring triglycerides and ranging in chain length of from about $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Suitable aryl substituted aliphatic alcohols are selected from aryl groups having 6 to 9 carbon atoms and wherein the hydroxyl group is attached to the aliphatic moiety. Preferred aryl substituted aliphatic alcohols are benzyl alcohol, alpha and beta phenylethyl alcohol, di- and tri-phenylmethanol. Most preferred is benzyl alcohol.

2. The Aliphatic or Aromatic Organic Solvent

An aliphatic or aromatic hydrocarbyl organic solvent may also be employed in the present invention. Suitable aliphatic solvents include dearomatized solvents, such as Exxsol D40 and D60, available from ExxonMobil, other aliphatic solvents, such as D15–20 Naphta, D115–145 Naphta and D31–35 Naphta, also available from ExxonMobil, and non-aromatic mineral spirits, and the like.

Suitable aromatic solvents include benzene, toluene, xylene or higher boiling aromatics or aromatic thinners, such as a $C_9$ aromatic solvent. A preferred solvent for use in the present invention is a $C_9$ aromatic solvent. This includes mixtures of $C_9$ aromatics such as trimethyl benzene and ethyl toluene or propyl benzene which exhibit good solvency and compatibility with fuels. Other aromatic petroleum distillates may also be used, and preferably they are not classified as volatile organic compounds. Preferred aromatic petroleum distillates are naphthalene depleted (i.e. contain less than about 1% by weight naphthalene) since naphthalene may be classified as a hazardous air pollutant. Suitable aromatic petroleum distillates are commercially available as AROMATIC 100, 150, 200 from ExxonMobil.

Preferably, the solvent employed will be a mixture of both an aliphatic alcohol and an aliphatic or aromatic organic solvent. In a particularly preferred embodiment, the solvent will be a mixture of 2-ethyl-hexanol and a $C_9$ aromatic solvent.

The Nitrogen-Containing Detergent Additive

The cleaning composition employed in the present invention will also contain at least one nitrogen-containing detergent additive. Suitable detergent additives for use in this invention include, for example, aliphatic hydrocarbyl amines, hydrocarbyl-substituted poly(oxyalkylene) amines, hydrocarbyl-substituted succinimides, Mannich reaction products, nitro and amino aromatic esters of polyalkylphenoxyalkanols, polyalkylphenoxyaminoalkanes, and mixtures thereof.

The aliphatic hydrocarbyl-substituted amines which may be employed in the present invention are typically straight or branched chain hydrocarbyl-substituted amines having at least one basic nitrogen atom and wherein the hydrocarbyl group has a number average molecular weight of about 700 to 3,000. Preferred aliphatic hydrocarbyl-substituted amines include polyisobutenyl and polyisobutyl monoamines and polyamines.

The aliphatic hydrocarbyl amines employed in this invention are prepared by conventional procedures known in the art. Such aliphatic hydrocarbyl amines and their preparations are described in detail in U.S. Pat. Nos. 3,438,757; 3,565,804; 3,574,576; 3,848,056; 3,960,515; 4,832,702; and 6,203,584, the disclosures of which are incorporated herein by reference.

Another class of detergent additives suitable for use in the present invention are the hydrocarbyl-substituted poly (oxyalkylene) amines, also referred to as polyether amines. Typical hydrocarbyl-substituted poly(oxyalkylene) amines include hydrocarbyl poly(oxyalkylene) monoamines and polyamines wherein the hydrocarbyl group contains from 1 to about 30 carbon atoms, the number of oxyalkylene units will range from about 5 to 100, and the amine moiety is derived from ammonia, a primary alkyl or secondary dialkyl monoamine, or a polyamine having a terminal amino nitrogen atom. Preferably, the oxyalkylene moiety will be oxypropylene or oxybutylene or a mixture thereof. Such hydrocarbyl-substituted poly(oxyalkylene) amines are described, for example, in U.S. Pat. No. 6,217,624 to Morris et al., and U.S. Pat. No. 5,112,364 to Rath et al., the disclosures of which are incorporated herein by reference.

A preferred type of hydrocarbyl-substituted poly (oxyalkylene) monoamine is an alkylphenyl poly (oxyalkylene)monoamine wherein the poly(oxyalkylene) moiety contains oxypropylene units or oxybutylene units or mixtures of oxypropylene and oxybutylene units. Preferably, the alkyl group on the alkylphenyl moiety is a straight or branched-chain alkyl of 1 to 24 carbon atoms. An especially preferred alkylphenyl moiety is tetrapropenylphenyl, that is, where the alkyl group is a branched-chain alkyl of 12 carbon atoms derived from propylene tetramer.

An additional type of hydrocarbyl-substituted poly (oxyalkylene)amine finding use in the present invention are hydrocarbyl-substituted poly(oxyalkylene) aminocarbamates disclosed for example, in U.S. Pat. Nos. 4,288,612; 4,236,020; 4,160,648; 4,191,537; 4,270,930; 4,233,168; 4,197,409; 4,243,798 and 4,881,945, the disclosure of each of which are incorporated herein by reference.

These hydrocarbyl poly(oxyalkylene)aminocarbamates contain at least one basic nitrogen atom and have an average molecular weight of about 500 to 10,000, preferably about 500 to 5,000, and more preferably about 1,000 to 3,000. A preferred aminocarbamate is alkylphenyl poly(oxybutylene) aminocarbamate wherein the amine moiety is derived from ethylene diamine or diethylene triamine.

A further class of detergent additives suitable for use in the present invention are the hydrocarbyl-substituted succinimides. Typical hydrocarbyl-substituted succinimides include polyalkyl and polyalkenyl succinimides wherein the polyalkyl or polyalkenyl group has an average molecular weight of about 500 to 5,000, and preferably about 700 to 3,000. The hydrocarbyl-substituted succinimides are typically prepared by reacting a hydrocarbyl-substituted succinic anhydride with an amine or polyamine having at least one reactive hydrogen bonded to an amine nitrogen atom. Preferred hydrocarbyl-substituted succinimides include polyisobutenyl and polyisobutanyl succinimides, and derivatives thereof.

The hydrocarbyl-substituted succinimides finding use in the present invention are described, for example, in U.S. Pat. Nos. 5,393,309; 5,588,973; 5,620,486; 5,916,825; 5,954,843; 5,993,497; and 6,114,542, and British Patent No. 1,486,144, the disclosure of each of which are incorporated herein by reference.

Yet another class of detergent additives which may be employed in the present invention are Mannich reaction products which are typically obtained from the Mannich condensation of a high molecular weight alkyl-substituted hydroxyaromatic compound, an amine containing at least one reactive hydrogen, and an aldehyde. The high molecular weight alkyl-substituted hydroxyaromatic compounds are preferably polyalkylphenols, such as polypropylphenol and polybutylphenol, especially polyisobutylphenol, wherein the polyakyl group has an average molecular weight of about 600 to 3,000. The amine reactant is typically a polyamine, such as alkylene polyamines, especially ethylene or polyethylene polyamines, for example, ethylene diamine, diethylene triamine, triethylene tetramine, and the like. The aldehyde reactant is generally an aliphatic aldehyde, such as formaldehyde, including paraformaldehyde and formalin, and acetaldehyde. A preferred Mannich reaction product is obtained by condensing a polyisobutylphenol with formaldehyde and diethylene triamine, wherein the polyisobutyl group has an average molecular weight of about 1,000.

The Mannich reaction products suitable for use in the present invention are described, for example, in U.S. Pat. Nos. 4,231,759 and 5,697,988, the disclosures of each of which are incorporated herein by reference.

A still further class of detergent additive suitable for use in the present invention are polyalkylphenoxyaminoalkanes. Preferred polyalkylphenoxyaminoalkanes include those having the formula:

(III)

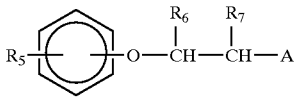

wherein:

$R_5$ is a polyalkyl group having an average molecular weight in the range of about 600 to 5,000;

$R_6$ and $R_7$ are independently hydrogen or lower alkyl having 1 to 6 carbon atoms; and A is amino, N-alkyl amino having about 1 to about 20 carbon atoms in the alkyl group, N,N-dialkyl amino having about 1 to about 20 carbon atoms in each alkyl group, or a polyamine moiety having about 2 to about 12 amine nitrogen atoms and about 2 to about 40 carbon atoms.

The polyalkylphenoxyaminoalkanes of Formula III above and their preparations are described in detail in U.S. Pat. No. 5,669,939, the disclosure of which is incorporated herein by reference.

Mixtures of polyalkylphenoxyaminoalkanes and poly (oxyalkylene) amines are also suitable for use in the present invention. These mixtures are described in detail in U.S. Pat. No. 5,851,242, the disclosure of which is incorporated herein by reference.

A preferred class of detergent additive finding use in the present invention are nitro and amino aromatic esters of polyalkylphenoxyalkanols. Preferred nitro and amino aromatic esters of polyalkylphenoxyalkanols include those having the formula:

(IV)

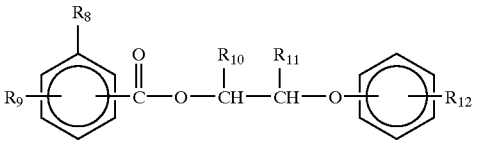

wherein:

$R_8$ is nitro or $—(CH_2)_n—NR_{13}R_{14}$, wherein $R_{13}$ and $R_{14}$ are independently hydrogen or lower alkyl having 1 to 6 carbon atoms and n is 0 or 1;

$R_9$ is hydrogen, hydroxy, nitro or $—NR_{15}R_{16}$, wherein $R_{15}$ and $R_{16}$ are independently hydrogen or lower alkyl having 1 to 6 carbon atoms;

$R_{10}$ and $R_{11}$ are independently hydrogen or lower alkyl having 1 to 6 carbon atoms; and $R_{12}$ is a polyalkyl group having an average molecular weight in the range of about 450 to 5,000.

The aromatic esters of polyalkylphenoxyalkanols shown in Formula IV above and their preparations are described in detail in U.S. Pat. No. 5,618,320, the disclosure of which is incorporated herein by reference.

Mixtures of nitro and amino aromatic esters of polyalkylphenoxyalkanols and hydrocarbyl-substituted poly (oxyalkylene) amines are also preferably contemplated for use in the present invention. These mixtures are described in detail in U.S. Pat. No. 5,749,929, the disclosure of which is incorporated herein by reference.

Preferred hydrocarbyl-substituted poly(oxyalkylene) amines which may be employed as detergent additives in the present invention include those having the formula:

(V)

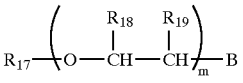

wherein:

$R_{17}$ is a hydrocarbyl group having from about 1 to about 30 carbon atoms;

$R_{18}$ and $R_{19}$ are each independently hydrogen or lower alkyl having about 1 to about 6 carbon atoms and each $R_{18}$ and $R_{19}$ is independently selected in each $—O—CHR_{18}—CHR_{19}—$ unit;

B is amino, N-alkyl amino having about 1 to about 20 carbon atoms in the alkyl group, N,N-dialkyl amino having about 1 to about 20 carbon atoms in each alkyl group, or a polyamine moiety having about 2 to about 12 amine nitrogen atoms and about 2 to about 40 carbon atoms; and m is an integer from about 5 to about 100.

The hydrocarbyl-substituted poly(oxyalkylene) amines of Formula V above and their preparations are described in detail in U.S. Pat. No. 6,217,624, the disclosure of which is incorporated herein by reference.

The hydrocarbyl-substituted poly(oxyalkylene) amines of Formula V are preferably utilized either by themselves or in combination with other detergent additives, particularly with the polyalkylphenoxyaminoalkanes of Formula III or the nitro and amino aromatic esters of polyalkylphenoxyalkanols shown in Formula IV. More preferably, the detergent additives employed in the present invention will be combinations of the hydrocarbyl-substituted poly(oxyalkylene) amines of Formula V with the nitro and amino aromatic esters of polyalkylphenoxyalkanols shown, in Formula IV. A particularly preferred hydrocarbyl-substituted poly (oxyalkylene) amine detergent additive is dodecylphenoxy poly(oxybutylene) amine and a particularly preferred combination of detergent additives is the combination of dodecylphenoxy poly(oxybutylene) amine and 4-polyisobutylphenoxyethyl para-aminobenzoate.

Another type of detergent additive suitable for use in the present invention are the nitrogen-containing carburetor/injector detergents. The carburetor/injector detergent additives are typically relatively low molecular weight compounds having a number average molecular weight of about 100 to about 600 and possessing at least one polar moiety and at least one non-polar moiety. The non-polar moiety is typically a linear or branched-chain alkyl or alkenyl group having about 6 to about 40 carbon atoms. The polar moiety is typically nitrogen-containing. Typical nitrogen-containing polar moieties include amines (for example, as described in U.S. Pat. No. 5,139,534 and PCT International Publication No. WO 90/10051), ether amines (for example, as described in U.S. Pat. No. 3,849,083 and PCT International Publication No. WO 90/10051), amides, polyamides and amide-esters (for example, as described in U.S. Pat. Nos. 2,622,018; 4,729,769; and 5,139,534; and European Patent Publication No. 149,486), imidazolines (for example, as described in U.S. Pat. No. 4,518,782), amine oxides (for example, as described in U.S. Pat. Nos. 4,810,263 and 4,836,829), hydroxyamines (for example, as described in U.S. Pat. No. 4,409,000), and succinimides (for example, as described in U.S. Pat. No. 4,292,046).

The Cyclic Carbonate

Preferred cyclic carbonates include those having the formula:

(VI)

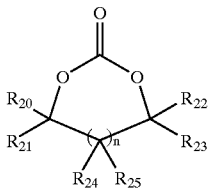

wherein:

$R_{20}$, $R_{21}$, $R_{22}$, $R_{23}$, $R_{24}$, and $R_{25}$ are independently selected from hydrogen, hydroxy, hydroxymethyl, hydroxyethyl, hydrocarbyl group from about 1 to 6 carbon atoms; n is an integer from zero to one. Preferably, $R_{20}$, $R_{21}$, $R_{22}$, $R_{23}$, $R_{24}$, $R_{25}$ are hydrogen or lower alkyl of 1 to 2 carbon atoms, and more preferably hydrogen or methyl.

Preferred cyclic carbonates for use in this invention are those of formula 1 above where n is zero and where $R_{20}$, $R_{21}$, $R_{22}$ are hydrogen and $R_{23}$ is methyl, ethyl or hydroxymethyl. Preferably when n is 1, $R_{21}$, $R_{22}$, $R_{23}$, $R_{24}$, $R_{25}$ are hydrogen. Most preferred are ethylene carbonate, propylene carbonate and the butylene carbonates which are defined below.

The following are examples of suitable cyclic carbonates for use in this invention as well as mixtures thereof: 1,3-dioxolan-2-one (also referred to as ethylene carbonate); 4-methyl-1,3-dioxolan-2-one (also referred to as propylene carbonate); 4-hydroxymethyl-1,3-dioxolan-2-one; 4,5-dimethyl-1,3-dioxolan-2-one; 4-ethyl-1,3-dioxolan-2-one; 4,4-dimethyl-1,3-dioxolan-2-one (previous three also referred to as butylenes carbonates); 4-methyl-5-ethyl-1,3-dioxolan-2-one; 4,5-diethyl-1,3-dioxolan-2-one; 4,4-diethyl-1,3-dioxolan-2-one; 1,3-dioxan-2-one; 4,4-dimethyl-1,3-dioxan-2-one; 5,5-dimethyl-1,3-dioxan-2-one; 5,5-dihydroxymethyl-1,3-dioxan-2-one; 5-methyl-1,3-dioxan-2-one; 4-methyl-1,3-dioxan-2-one; 5-hydroxy-1,3-dioxan-2-one; 5-hydroxymethyl-5-methyl-1,3-dioxan-2-one; 5,5-diethyl-1,3-dioxan-2-one; 5-methyl-5-propyl-1,3-dioxan-2-one; 4,6-dimethyl-1,3-dioxan-2-one; and 4,4,6-trimethyl-1,3-dioxan-2-one. Other suitable cyclic carbonates may be prepared from visconal diols prepared from $C_1$–$C_{30}$ olefins by methods known in the art.

Several of these cyclic carbonates are commercially available such as 1,3-dioxolan-2-one or 4-methyl-1,3-dioxolan-2-one sold for example by Lyondell Chemical Company under the trade name ARCONATE. Alternatively, Huntsman Performance Chemicals also sells, ethylene carbonate, propylene carbonate, 1,2 butylene carbonate as well as mixtures thereof under the trade name JEFFSOL. Cyclic carbonates may be readily prepared by known reactions. For example although not preferred, reaction of phosgene with a suitable alpha alkane diol or an alkan-1,3-diol yields a carbonate for use within the scope of this invention as for instance in U.S. Pat. No. 4,115,206 which is incorporated herein by reference.

Likewise, the cyclic carbonates useful for this invention may be prepared by transesterification of a suitable alpha alkane diol or an alkan-1,3-diol with, e.g., diethyl carbonate under transesterification conditions. See, for instance, U.S. Pat. Nos. 4,384,115 and 4,423,205 which are incorporated herein by reference for their teaching of the preparation of cyclic carbonates. Catalytic processes employing Cr(III)- and Co(III)-based catalyst system can also be used for synthesis of cyclic carbonates from the coupling of $CO_2$ and terminal epoxides under mild conditions. For example, propylene oxide reacts with $CO_2$ in the presence of these complexes to afford propylene carbonate quantitatively. The reaction can be run with or without solvent, at modest temperatures (25–100° C.), $CO_2$ pressures (1–5 atm), and low catalyst level (0.075 mol %).

As used herein, the term "alpha alkane diol" means an alkane group having two hydroxyl substituents wherein the hydroxyl substituents are on adjacent carbons to each other. Examples of alpha alkane diols include 1,2-propanediol, 2,3-butanediol and the like. Likewise, the term "alkan-1,3-diol" refers to an alkane group having two hydroxyl substituents wherein the hydroxyl substituents are beta substituted. That is, there is a methylene or a substituted methylene moiety between the hydroxyl substituted carbons. Examples of alkan-1,3-diols include propan-1,3-diol, pentan-2,4-diol and the like.

The alpha alkane diols, used to prepare the 1,3-dioxolan-2-ones employed in this invention, are either commercially available or may be prepared from the corresponding olefin by methods known in the art. For example, the olefin may first react with a peracid, such as peroxyacetic acid or hydrogen peroxide to form the corresponding epoxide which is readily hydrolyzed under acid or base catalysis to the alpha alkane diol. In another process, the olefin is first halogenated to a dihalo derivative and subsequently hydrolyzed to an alpha alkane diol by reaction first with sodium acetate and then with sodium hydroxide. The olefins so employed are known in the art.

The alkan-1,3-diols, used to prepare the 1,3-dioxan-2-ones employed in this invention, are either commercially available or may be prepared by standard techniques, e.g., derivatizing malonic acid.

4-Hydroxymethyl 1,3-dioxolan-2-one derivatives and 5-hydroxy-1,3-dioxan-2-one derivatives may be prepared by employing glycerol or substituted glycerol in the process of U.S. Pat. No. 4,115,206. The mixture so prepared may be separated, if desired, by conventional techniques. Preferably the mixture is used as is.

5,5-Dihydroxymethyl-1,3-dioxan-2-one may be prepared by reacting an equivalent of pentaerythritol with an equivalent of either phosgene or diethylcarbonate (or the like) under transesterification conditions.

5-hydroxymethyl-5-methyl-1,3-dioxan-2-one may be prepared by reacting an equivalent of trimethylolethane with an equivalent of either phosgene or diethylcarbonate (or the like) under transesterification conditions.

Formulation

As described above, preferably the cleaning composition employed in the present invention comprises a first and second cleaning solution. The first solution comprises a mixture of (a) a phenoxy mono- or poly(oxyalkylene) alcohol, (b) at least one solvent selected from (1) an alkoxy aliphatic alcohol and (2) an aliphatic or aromatic organic solvent, and (c) at least one nitrogen-containing detergent additive. The first solution will generally contain (a) about 10 to 70 weight percent, preferably about 10 to 50 weight percent, more preferably about 15 to 45 weight percent, of the phenoxy mono- or poly(oxyalkylene) alcohol, (b) about 5 to 50 weight percent, preferably 10 to 30 weight percent, more preferably about 15 to 25 weight percent, of the solvent or mixture of solvents, and (c) about 1 to 60 weight percent, preferably 10 to 50 weight percent, more preferably about 15 to 45 weight percent, of the detergent additive or mixture of additives. When the solvent component is a mixture of an aliphatic alcohol and an aliphatic or aromatic organic solvent, the cleaning composition will generally contain about 5 to 30 weight percent, preferably about 5 to 15 weight percent of the aliphatic alcohol and about 5 to 30 weight percent, preferably 5 to 15 weight percent of the aliphatic or aromatic organic solvent. When the detergent component contains the preferred combination of a poly (oxyalkylene) amine and an aromatic ester of a polyalkylphenoxyalkanol, the cleaning composition will generally contain about 0.5 to 45 weight percent, preferably 8 to 40 weight percent of the poly(oxyalkylene) amine and about 0.5 to 15 weight percent, preferably 1 to 10 weight percent of the aromatic ester of a polyalkylphenoxyalkanol.

As mentioned above, the second cleaning solution comprises a homogeneous mixture of (a) a phenoxy mono- or poly(oxyalkylene) alcohol, (b) a cyclic carbonate, and (c) water.

The phenoxy mono- or poly(oxyalkylene) alcohol component of the second solution will be a compound or mixture of compounds of Formula I above, and may be the same or different from the phenoxy mono- or poly(oxyalkylene) alcohol component of the initial cleaning composition. The second cleaning solution will generally contain (a) about 5 to 95 weight percent, preferably about 20 to 85 weight percent, of the phenoxy mono- or poly(oxyalkylene) alcohol, (b) about 5 to 95 weight percent, preferably about 5 to 50 weight percent, of the cyclic carbonate, and (c) about 5 to 25 weight percent, preferably about 5 to 20 weight percent, of water.

Formulation A: A two part cleaning composition was prepared for use in the examples: the first cleaning solution incorporated 2-phenoxyethanol, 2-ethyl hexanol, a $C_9$ aromatic solvent and a detergent additive mixture. More specifically, the first cleaning solution incorporated approximately: 35.5 wt % Dodecylphenoxy Poly(oxybutylene) Amine, 2.6 wt % 4-Polyisobutylphenoxyethyl para-aminobenzoate, 13.7 wt % C9 aromatic solvent, 42.2 wt % 2-Phenoxyethanol and 6.0 wt % 2-Ethyl Hexanol. Wherein the dodecylphenoxy poly(oxybutylene) amine and the 4-polyisobutylphenoxyethyl para-aminobenzoate was prepared as described in U.S. Pat. No. 5,749,9296. The 2-phenoxyethanol is available from Dow Chemical Company as EPH Dowanol. The second cleaning composition employed an aqueous solution containing approximately: 47.5 wt % 2-phenoxyethanol, 47.5 wt % propylene carbonate with the remainder water.

Formulation B contained a first cleaning solution incorporated approximately: 33 wt % Dodecylphenoxy Poly (oxybutylene) Amine, 5 wt % 4-Polyisobutylphenoxyethyl para-aminobenzoate, 10 wt % C9 aromatic solvent, 42 wt % 2-Phenoxyethanol and 10 wt % 2-Butoxyethanol. The second cleaning composition employed an aqueous solution containing approximately: 80 wt % 2-phenoxyethanol, 10 wt % 2-butoxyethanol with the remainder water.

EXAMPLES

A further understanding of the invention can be had in the following nonlimiting examples,

Comparative Example A

PFI Engine Example:—Intake deposits employing a commercial apparatus is demonstrated. The method described below was used to achieve deposit removal in Port Fuel Injected (PFI) internal combustion engines using cleaning solution described above. The procedure was demonstrated in a 1996 GM LD9, 2.3 L engine dynamometer test stand.

Deposit formation and removal experiments were carried out using the following procedures:

The LD9 engine was assembled using all clean components.

The engine was operated for 100 hours to accumulate sufficient deposits.

After deposit formation phase was completed, the engine was disassembled and intake system and combustion chamber deposit thickness and weight were measured and recorded. The measured engine was then assembled for the clean up phase.

Deposit removal was performed after the engine was fully warmed up and while it was operating at fast idle (1500 RPM). A total of 650 ml of the two cleaning solutions of Formulation A, (350 ml of each solution, added separately or combined) was delivered through the intake manifold using a commercially available apparatus which atomizes the formulations upstream of the throttle plate assembly. Total application time was approximately 25–35 minutes. The commercially available apparatus consists of a pressurized container, a regulator, a flow control valve, and a nozzle to achieve a spray jet. In situations where part one and two were combined, the injection pressure was set in the range of 30–60 psig. In some experiments, part one and part two were supplied separately, and since the two formulations have different viscosities, the pressure regulator was used to vary the supplied pressure to achieve appropriate flow rate for each product. In this situation, the first cleaning solution was applied at 40–60 psig, while second cleaning solution was applied at 15–30 psig.

Upon completion of the procedure, the engine was allowed to idle for 3–5 minutes before shutting down. To determine clean up performance, the engine was disassembled once again and intake system and combustion chamber deposit thickness and weight were measured. Percent intake valve clean-up when cleaning solutions were added sequentially were 25.8% (average intake valve deposit weight 231 mg dirty and 171 mg after clean-up) and 20.7% (average intake valve deposit weight 239 mg dirty and 190 mg after clean-up) respectively, when cleaning solutions 1 and 2 were mixed prior to addition.

Comparative Example B

DISI Engine Example:—The commercial apparatus and method described in Comparative Example A, was substantially repeated to achieve deposit removal in Direct Injection Spark Ignition (DISI) internal combustion engines. The particular engine was a 1998, 2.4 L Mitsubishi DISI engine.

Deposit formation and removal experiments were carried out using the following procedures:

The DISI engine was assembled using all clean components. The engine was then operated for 200 hour which constituted the deposit formation phase of the experiments. After deposit formation phase, the engine was disassembled and intake system deposit weights were measure and recorded. The measured engine was then assembled for the clean up phase.

Deposit removal phase was performed after the engine was fully warmed up and while it was operating at fast idle (2000–2500 RPM), however, this procedure could be conducted at manufacturer recommended idle speeds to approximately 3500 RPM.

In this experiment, a total of 1150 ml of the two-part cleaning solution (Formulation B) was delivered through the intake manifold using a commercially available apparatus which atomizes and delivers the formulations upstream of the throttle plate assembly. Total application time was approximately 40 minutes. The commercially available apparatus consists of a pressurized container, a regulator, a flow control valve, and a nozzle to achieve a spray jet. In this experiment, part one and part two were supplied separately, and since the two formulations have different viscosities, the pressure regulator was used to vary the supplied pressure to achieve appropriate flow rate for each product (the first cleaning solution was applied at 40–60 psig, while second cleaning solution was applied at 15–30 psig). Upon completion of the procedures, the engine was allowed to idle for 3–5 minutes before shutting down.). It is worth noting that upon completion of the experiment, and after the engine was disassembled, it was observed that approximately 39 percent of the cleaning solution was accumulated in the intake system resonator. This is a major concern since it is possible that at higher engine speeds, the accumulated fluid uncontrollably is redrawn into the combustion chamber, thus causing catastrophic engine failure via a phenomenon called hydraulic locking. To determine clean up performance, the engine was disassembled once again and intake system deposit weights were measured. Percent intake valve clean-up when cleaning solutions were added sequentially was 20.9% (average intake valve deposit weight 355.6 mg dirty and 305 mg after clean-up).

Example 1

DISI Engine Example:—Intake system deposit removal for a Direct Injection Spark Ignition (DISI) internal combustion engines using the apparatus and application tool of this invention. The particular engine was a 1998, 2.4 L Mitsubishi DISI engine, the cleaning composition was formulation A.

Deposit formation and removal experiments were carried out using the following procedures:

The DISI engine was assembled using all clean components. The engine was then operated for 200 hour which constituted the deposit formation phase of the experiments. After deposit formation phase, the engine was disassembled and intake system deposit weights were measure and recorded. The measured engine was then assembled for the clean up phase.

Engine vacuum was the motive force to deliver cleaning composition to the interior cavity of the engine. A convenient access point for discretely introducing the cleaning composition is the intake manifold; and more specifically, the positive crankcase ventilation (PCV) rail. This rail is in communication and in closer proximity to the inlet valves; allowing for a more concentrated cleaning composition to be administered upstream of each affected intake port and allowing for increased deposit removal. A transport means was inserted inside the PCV rail through the PCV port to the desired location to thereby deliver the cleaning composition to each intake port. This aspect used a flexible treatment manifold inserted inside the interior of the engine and having an outlet for transporting the fluid to the location. Coupled with the treatment manifold was a seal for sealing the remainder of the PCV port. The treatment manifold was marked to indicate the desired insertion depth. The treatment manifold allowed for traverse within the PCV rail, so that the treatment manifold outlet could correspond to each intake runner allowing the treatment composition to be evenly distributed amongst the cylinders. A flow control valve in communication with the transport means was set and adjusted to allow for a wide range of delivery of cleaning fluids ranging from about 10 to about 140 milliliters per minute.

In the present example, the flow control valve was adjusted to achieve a flow rate of approximately 30 ml/min under intake vacuum. After the flow rate was adjusted, the cleaning composition was distributed sequentially to the inlet ports using a proportional amount of the cleaning composition. In the case of successive cleaning compositions to be introduced, a similar operation as above, was undertaken. A total of 1150 ml of the two cleaning solutions of Formulation B was delivered (575 ml of each solution added sequentially) to the engine resulting in total application time of approximately 40 minutes. Upon completion of the procedures, the engine was allowed to idle for 3–5 minutes before shutting down. To determine clean up performance, the engine was disassembled once again and intake system deposit weights were measured. Percent intake valve clean-up when cleaning solutions were added sequentially was 34.6% % (average intake valve deposit weight 529 mg dirty and 346.2 mg after clean-up).

Example 2

DISI Engine Example:—This employed the same type of engine and deposit formation as described in Example 1. This example was performed using a different apparatus and application tool for delivering the cleaning compositions. The application tool comprised of a pressurized container, a pressure regulator and metering valve to control the pressure and the flow rate of the additive composition, an elongated conduit coupled with a splitter connected to four flexible tubes with inner diameter of 0.76 mm, these tubes communicated with a seal and a treatment manifold which was placed inside the engine cavity. Delivery of the cleaning components was done via flexible tubes guided by rigid members of the treatment manifold. These tubes were sealed at a flange assembly which incorporated a sleeve assembly for precise delivery of the cleaning composition inside individual engine intake system runners (FIG. 3). The flange and sleeve assembly was placed between the throttle plate assembly and the engine intake manifold (FIG. 4). Proper alignment of the orifice located on distal end portion of the flexible tubes allowed for uniform product distribution among the individual intake ports. Separation of the orifice to an internal wall was accomplished by attaching hollow spherical objects to the distal end portion of the flexible tubes. This was done to ensure that the cleaning solution was discharged outside the boundary layer and away from the intake system surfaces.

In this example, the two part formulation was applied separately, and since the two formulations have different viscosities, the pressure regulator was used to vary the supplied pressure to achieve appropriate flow rate for each product (the first cleaning solution was applied at 40–60 psig, while second cleaning solution was applied at 15–30 psig. A total of 1150 ml of the cleaning solution of Formulation B was applied in approximately 40 minutes.

Upon completion of the procedures, the engine was allowed to idle for 3–5 minutes before shutting down. To determine clean up performance, the engine was disassembled once again and intake system deposit weights were measured. Percent intake valve clean-up when cleaning solutions were added sequentially was 50.9% % (average intake valve deposit weight 510.9 mg dirty and 251 mg after clean-up).

Example 3

DISI Engine Example:—The method described below was used to achieve deposit removal in a 1998 Mitsubishi Carisma vehicle equipped with a 1.8 L DISI engine using the apparatus of Example 1.

Deposit formation and removal experiments were carried out using the following procedures:

The DISI engine was assembled using all clean components. The vehicle was operated on mileage accumulator lane for 8000 kilometer to accumulate sufficient deposits.

After deposit formation phase, the engine was disassembled and intake system and combustion chamber deposit thickness and weight were measure and recorded. The measured engine was then assembled for the clean up phase.

Deposit removal was performed after the engine was fully warmed up and while it was operating at fast idle (2000 RPM), however, this procedure could be conducted at manufacturer recommended idle speeds to approximately 3500 RPM. In the case of this DISI engine, a convenient access point for discretely introducing the cleaning composition is the intake manifold; and more specifically, the positive crankcase ventilation (PCV) rail. This rail is in communication and in closer proximity to the inlet valves; allowing for a more concentrated cleaning composition to be administered upstream of each affected intake port and allowing for increased deposit removal. A transport means was inserted inside the PCV rail through the PCV port to the desired location to thereby deliver the cleaning composition to each intake port. This aspect used a flexible treatment manifold inserted inside the interior of the engine and having an outlet for transporting the fluid to the location. Coupled with the treatment manifold was a seal for sealing the remainder of the PCV port. The treatment manifold was marked to indicate the desired insertion depth. The treatment manifold allowed for traverse within the PCV rail, so that the treatment manifold outlet could correspond to each intake runner allowing the treatment composition to be evenly distributed amongst the cylinders. A flow control valve in communication with the transport means was set and adjusted to allow for a wide range of delivery of cleaning fluids ranging from about 10 to about 140 milliliters per minute.

In the present example, the flow control valve was adjusted to achieve a flow rate of approximately 30 ml/min under intake vacuum. After the flow rate was adjusted, the cleaning composition was distributed sequentially to the inlet ports using a proportional amount of the cleaning composition. In the case of successive cleaning compositions to be introduced, a similar operation as above, was undertaken. A total of 1150 ml of the two cleaning solutions of formulation A was delivered (575 ml of each solution added sequentially) to the engine resulting in total application time of approximately 40 minutes.

Upon completion of the procedure, the engine was allowed to idle for 3–5 minutes before shutting down. To determine clean up performance, the engine was disassembled once again and intake system and combustion chamber deposit thickness and weight were measured. Percent intake valve clean-up when cleaning solutions were added sequentially was 51.1% % (average intake valve deposit weight 269 mg dirty and 131 mg after clean-up).

Examples 4–5

DISI Engine Examples:—The procedure of Example 3 was repeated using formulation B. Example 4 used approximately 335 ml of the first cleaning solution followed by 415 ml of the second cleaning solution. Example 5 used approximately 575 ml of the first cleaning solution followed by 575 ml of the second cleaning solution. Clean-up performance was measured and determined. Percent intake valve clean-up when cleaning solutions were added sequentially was 51.0% (average intake valve deposit weight 196 mg dirty and 96 mg after clean-up) for Example 4 and 53% (average intake valve deposit weight 294.2 mg dirty and 138 mg after clean-up) for Example 4.

TABLE 1

Experimental Data

| Example | Test Condition (Before and After) | AVG Intake Valve Deposit weight (mg) | AVG % Intake Valve Clean-up |
|---|---|---|---|
| Comparative | (Dirty) | 235 | 23.3% |
| Example A* | (After Clean-up) | 181 | |
| Comparative | (Dirty) | 356 | 20.9% |
| Example B | (After Clean-up) | 305 | |
| Example 1 | (Dirty) | 529 | 34.6% |
| | (After Clean-up) | 346 | |
| Example 2 | (Dirty) | 511 | 50.9% |
| | (After Clean-up) | 251 | |
| Example 3 | (Dirty) | 269 | 51.1% |
| | (After Clean-up) | 131 | |
| Example 4 | (Dirty) | 196 | 51.0% |
| | (After Clean-up) | 96 | |
| Example 5 | (Dirty) | 294 | 53% |
| | (After Clean-up) | 138 | |

*Average of two runs.

The experimental data in Table 1 display engine cleanliness as a calculated percent clean-up based upon the before and after results exemplified by this example. The percent clean-up value is calculated based upon (dirty component—cleaned component)/dirty component multiplied by 100 to yield the percent clean-up of the component. As can be seen, the apparatus and application tool employed in this invention provided a significant reduction in intake system and combustion chamber deposits over conventional technologies in both PFI and DISI engines.

Example 6

Performance Example—Diesel Engine:—The cleaning composition disclosed in Example 1 was also used to achieve deposit removal in a 2001, Ford HSDI 2.0 diesel engine. The engine was installed on a dynamometer engine stand. Prior to the clean up test, the engine cylinder head was removed and intake valve, piston top and cylinder head deposits were measured and recorded. Clean up procedure was performed using part 1 and part 2 formulations sequentially. Before the experiments, the engine was fully warmed up while running at 2500 RPM. In these experiments, two different engine speeds were tried (850 and 2400 RPM), however, 2400 RPM resulted in a more stable engine operation than 850 RPM. The two formulations were delivered inside the intake manifold system using a rail with eight nozzles, fed by a heating pump for better distribution of the products. The applicator rail was inserted inside the intake air manifold through the main intake air system opening. Nozzle spacing on the applicator rail was predetermined in such a way that the nozzles were aligned with the intake manifold runners once the applicator rail was placed inside the intake air manifold. After completion of the test, engine was allowed to run for approximately 10 minutes before shutting down. Deposit removal efficacy was determined by disassembling engine's cylinder head and measuring deposit weight and thickness. The engine cleanup performance was measured and calculated as described in Table 4. The results are as follows: the percent intake valve deposit cleanup improved by 24.7% (average intake valve deposit weight 240 mg dirty vs. 178 mg clean), the percent piston top cleanup improved by 41.5% (average piston top thickness 8.2 $\mu$m dirty vs. 4.8 $\mu$m clean) and the percent cylinder head cleanup improved by 70.6% (average cylinder head thickness 108 $\mu$m dirty vs. 10.2 $\mu$m clean. Thus clearly indicating the cleaning composition is effective in removing intake system and combustion chamber deposits from diesel engines.

Example 7

Performance Example—Natural Gas Engine:—The cleaning composition of Example 1 was used to clean a large bore natural gas engine. Deposit removal experiment was performed in a stationary, 12 cylinder, Waukesha engine with a total displacement volume of 115 L. Engine manifold was minimally modified to allow product delivery inside the intake ports and close to the valve tulips using a rigid tube connected to the container holding the formulations. The rigid delivery tube was inserted inside the intake system through a previously established access port which gave an unobstructed path to the intake port area. A needle valve was used to control the flow of the products for proper engine operation. Prior to the clean up experiment, it was verified through visual inspection using a video scope that the engine has accumulated a significant level of deposits inside the intake system and combustion chambers from hours of operation in a natural gas field. The engine was then warmed up at idle. The cleaning solutions were introduced inside the intake system sequentially and while the engine was idling. Upon completion of the test, deposit removal was assessed using the same video scope and without disassembling the engine. Visual inspection by trained technicians revealed a significant deposit removal (up to 100 percent) from both the intake system and combustion chamber surfaces.

What is claimed is:

1. An apparatus for administering a cleaning solution to an interior surface of a reciprocating engine system comprising an elongated conduit in fluid communication with a treatment manifold adapted for positioning into the interior of a reciprocating engine cavity through an access port, said treatment manifold having a bore therethrough and at least one maneuverable end portion having an orifice for directing fluid delivery to an interior surface of said engine requiring cleaning, wherein the treatment manifold is of sufficient length such that the orifice is positionable independently of the location of the access port, and a seal member circumscribing and in cooperation with said treatment manifold to releaseably engage with the access port of the engine.

2. The apparatus of claim 1 wherein the treatment manifold is adapted for positioning in an air intake system of an internal combustion engine.

3. The apparatus of claim 2 wherein the air intake system of the internal combustion engine further comprises a throttle plate assembly and wherein the treatment manifold is adapted for positioning downstream of said throttle plate assembly.

4. The apparatus of claim 3 wherein the engine further contains a PCV port and the seal member engages the PCV port.

5. The apparatus of claim 3 wherein the seal member engages with the throttle plate assembly.

6. The apparatus of claim 1 wherein the treatment manifold has a first end portion in communication with the elongated conduit and seal member, and a second end portion having a plurality of orifices.

7. The apparatus of claim 1 wherein the treatment manifold further comprises a guiding means for positioning the maneuverable end portion.

8. An apparatus for delivering a cleaning composition to multiple independent interior surfaces of an engine system requiring cleaning comprising an elongated conduit in fluid communication with a treatment manifold adapted for insertion into the interior cavity of a reciprocating engine through an access port, said treatment manifold having a central bore in communication with a plurality of orifices disposed on said central bore and extending radially outward therefrom, said orifices positionable along the central bore to provide a plurality of discrete delivery points for substantially directing the cleaning composition to a plurality of preselected interior engine surfaces independent from the location of the access port, and a seal member circumscribing and cooperating with said treatment manifold to releaseably engage with the access port of said engine.

9. The apparatus of claim 8 wherein the orifices have different internal diameters.

10. The apparatus of claim 8 wherein the seal member cooperates with the treatment manifold such that the manifold is selectively positionable within the engine cavity.

11. An apparatus for delivering a cleaning composition to an interior surface of an engine system comprising an elongated conduit in fluid communication with a treatment manifold adapted for insertion into the interior cavity of a reciprocating engine through an access port, said treatment manifold having a plurality of independently directible tubes having a passageway therethrough and at least one orifice disposed on each tube for a discrete point of fluid delivery, said tubes having proximal and distal ends, wherein the proximal ends are in communication with a seal member, and at least one distal end of a tube positionable to an interior surface to be cleaned.

12. The apparatus of claim 11 further comprising a guiding means for positioning at least one distal end to a location substantially adjacent to an interior surface of the engine requiring cleaning.

13. The apparatus of claim 11 further comprising a guiding member in communication with the seal member, said guiding member circumscribing the directable tubes for positioning a maneuverable end portion within the interior cavity of said engine.

14. The apparatus of claim 13 wherein the guiding member is rigid.

15. The apparatus of claim 14 wherein the guiding member has a keyway and is keyed with the directable tube to maintain the orientation of the directable tube.

16. The apparatus of claim 13 further comprising a positioning member enveloping at least one orifice to maintain a preselected distance of said orifice to the interior engine surface.

17. The apparatus of claim 11 wherein the elongated conduit further comprises a splitter having a single inlet and multiple outlets in fluid communication with the plurality of independently directable tubes of the treatment manifold.

18. An application tool attachable to an air intake system of an internal combustion engine for administering and directing a cleaning composition to remove interior carbonaceous engine deposit comprising:

(a) a pressure resistant reservoir container having an inlet in communication with a pressure regulator and a discharge outlet, said container charged with an engine cleaning composition, (b) an adjustable valve connected to the discharge outlet of the pressure resistant reservoir container, (c) at least one elongated conduit having a proximal end and a distal end with a bore extending throughout, the proximal end being connectably attached to the adjustable valve for receiving the engine cleaning composition discharged from the pressure resistant reservoir container upon actuation of the valve, (d) a treatment manifold in fluid communication with the distal end portion of the at least one elongated conduit, the treatment manifold adapted for insertion into the interior cavity of the engine through an access port within said engine, said treatment manifold having at least one directable tube with an orifice for fluid delivery extending within the interior engine cavity from the access port, a guide member concentric to a portion of the directable tube for positioning said orifice in proximity to a surface to be cleaned, and (e) a seal member which is releasably engagible with the access port and cooperates with the elongated conduit and treatment manifold to allow for transport of fluid therethrough.

19. The application tool according to claim 18 further comprising a gauge connected in series to the discharge outlet of the pressure resistant reservoir container.

20. The application tool according to claim 18 wherein the elongated conduit further comprises a splitter having a single inlet and multiple outlets in fluid communication with the plurality of directable tubes of the treatment manifold.

* * * * *